US006860759B2

(12) United States Patent
Nakamura et al.

(10) Patent No.: US 6,860,759 B2
(45) Date of Patent: Mar. 1, 2005

(54) CONNECTOR AND METHOD OF MOUNTING A CONNECTOR HOUSING ON A PANEL

(75) Inventors: Hideto Nakamura, Yokkaichi (JP); Kei Yanagisawa, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/320,830

(22) Filed: Dec. 16, 2002

(65) Prior Publication Data

US 2003/0114044 A1 Jun. 19, 2003

(30) Foreign Application Priority Data

Dec. 17, 2001 (JP) ..... 2001-383687
Dec. 17, 2001 (JP) ..... 2001-383697

(51) Int. Cl.[7] ..... H01R 13/73
(52) U.S. Cl. ..... 439/557
(58) Field of Search ..... 439/557, 544, 439/489, 752

(56) References Cited

U.S. PATENT DOCUMENTS 4,407,042 A * 10/1983 Schramme et al. ..... 16/2.1
5,238,427 A * 8/1993 Fry et al. ..... 439/557
5,249,982 A * 10/1993 Funck et al. ..... 439/556
5,391,086 A * 2/1995 Woller et al. ..... 439/157
5,514,000 A * 5/1996 Krause et al. ..... 439/248
5,545,061 A * 8/1996 Sawayanagi ..... 439/752
5,621,328 A * 4/1997 Yamanashi ..... 324/538
5,660,564 A * 8/1997 Yamanashi et al. ..... 439/557
5,779,500 A 7/1998 Tokuwa et al. ..... 439/557
5,791,935 A * 8/1998 Yamanashi ..... 439/489
5,800,208 A * 9/1998 Ishizuka et al. ..... 439/557
5,803,758 A * 9/1998 Kameyama ..... 439/248
6,033,241 A * 3/2000 Iwata et al. ..... 439/157
6,210,217 B1 * 4/2001 Ping ..... 439/557
6,592,384 B2 * 7/2003 Sawayanagi ..... 439/157

* cited by examiner

*Primary Examiner*—J. F. Duvernne
(74) *Attorney, Agent, or Firm*—Gerald E. Hespos; Anthony J. Casella

(57) ABSTRACT

A housing (20) of a connector has a front end that can be introduced through a mount hole (H) in a panel (P). A detector (50) is mounted on the front end of the housing (20) is movable between a standby position and a detecting position. Movement of the detector (50) toward the detecting position is prevented by interference with the inner peripheral surface of the mount hole (H) while the housing (20) is being mounted on the panel (P). However, the inner peripheral surface of the mount hole (H) when the male housing (20) is mounted properly on the panel (P). Thus, the detector (50) can be moved to the detecting position.

17 Claims, 37 Drawing Sheets

CONNECTOR AND METHOD OF MOUNTING A CONNECTOR HOUSING ON A PANEL

BACKGROUND OF THE INVENTION

1. Field of the Invention

The invention relates to a connector mountable on a panel and to a method of mounting a connector housing of a connector on a panel.

2. Description of the Related Art

U.S. Pat. No. 5,779,500 and FIG. 37 herein show a connector that is mountable on a door panel of an automotive vehicle. With reference to FIG. 37, the connector has a housing 1 that can pass through a mount hole H in a panel P. The housing 1 has a flange 2 and opposite locks 3 spaced from the flange 2. The housing 1 is mounted on the panel P by first passing one lock 3 through the mount hole H and engaging adjacent parts of the flange 2 with the panel P. The opposite side of the housing 1 then is pivoted toward the panel 1. As a result, the opposite lock 3 passes through the mount hole H and the flange 2 contacts a surface of the panel P. Thus, the panel P is held between the lock 3 and the flange 2, and the housing 1 is mounted on the panel P.

An operator may mistakenly believe that the housing 1 has been mounted even though the housing 1 has been mounted only partly. For example, the housing 1 may not be fixed firmly to the panel P at an intermediate stage of the mounting operation, and there are problems with leaving the housing 1 partly mounted.

The present invention was developed in view of the above problem, and an object thereof is to prevent a connector housing from being left partly mounted on a panel.

SUMMARY OF THE INVENTION

The invention is directed to a connector that can be passed through and mounted to a mount hole in a panel. The invention comprises a holding means for holding the housing on the panel, and a detecting means for detecting whether the housing is mounted properly on the panel. Thus, the detecting means prevents the housing from being left partly mounted.

The detecting means may comprise a detector on one of the housing and the panel for movement to a detecting position. The detecting means may also comprise a preventing portion on the other of the housing and the panel for interfering with the detector. The preventing portion hinders movement of the detector to the detecting position while the housing is being mounted on the panel. However, the detector does not interfere with the preventing portion when the housing is mounted properly, thereby enabling the detector to be moved to the detecting position. In this way, the mounted state of the housing can be detected based on whether the detector can be moved to the detecting position.

The detector preferably is assembled to the housing for movement along a direction that intersects a mounting direction of the housing on the panel. Additionally, the preventing portion preferably is formed by the inner peripheral surface of the mount hole. The detecting portion is located in the mount hole while the housing is being mounted on the panel. Hence, the inner peripheral surface of the mount hole prevents movement of the detector. However, the detecting portion is passed through the mount hole when the housing is mounted properly and the inner peripheral surface of the mount hole does not impede movement of the detector to the detecting position.

The inner peripheral surface of the mount hole is an existing structure. Thus, the panel need not have a special structure as the preventing portion and production costs can be reduced.

A detecting portion of the detecting means preferably engages a surface of the panel at a side opposite from a side where the housing is mounted when the detector reaches the detecting position.

Both the detecting portion of the detector and the holding means engage the panel. Therefore, the housing can be held more firmly on the panel.

The holding means preferably is on the housing and comprises a contact for contacting a first surface of the panel. The holding means preferably also comprises a securing portion and a resilient lock for engaging the second surface of the panel. The securing portion passes through the mount hole and engages the second surface of the panel. The lock then engages an edge of the mount hole, deforms sufficiently to pass through the mount hole, and finally restores resiliently to engage the second surface of the panel. The detector then is moved to the detecting position and engages the second surface of the panel.

The housing is mounted to the mount hole so that the panel is held tightly between the contact and both the lock and the securing portion. The detector is moved to the detecting position so that the detecting portion engages the side of the panel corresponding to the resilient lock. Thus, the housing is held stably on the panel even if the lock is deformed inadvertently and disengaged from the panel.

The housing is mounted from the rear of the panel. However, an operable portion of the detector is accessible from the front of the panel.

The detecting portion may have a guide surface for correcting the posture of the housing to a proper mounting posture. The guide surface slides in contact with the preventing portion when an attempt is made to move the detector to the detecting position when the housing is near proper mounting.

The resilient lock preferably is deformable into a deformation space. A detecting means may be on a mating housing that is connectable with the housing on the panel and comprises a deformation preventing portion that enters the deformation space as the two housings are connected.

The resilient lock is retracted from the deformation space when the housing is mounted properly, and the panel is held between the contact and the resilient lock. Thus, the connecting operation with the mating housing is permitted in this state, and deformation of the resilient lock is prevented by the entry of the deformation-preventing portion into the deformation space. On the other hand, the resilient lock is deformed into the deformation space when the housing is being mounted on the panel. Thus, contact of the deformation-preventing portion with the deformed resilient lock prevents connection. In this way, the mounted state of the housing on the panel can be detected based on whether the mating housing can be connected with the housing. The deformation-preventing portion prevents further deformation of the lock when the housings are connected. Therefore, the housing is held stably on the panel.

The detecting means may comprise a detector on one of the housing and the panel and movable from a standby position to a detecting position, and a locking means for holding the detector at the standby position. The locking means prevents the detector from inadvertently moving toward the detecting position before the housing is mounted on the panel. Thus, operability is good.

One of the housing and the panel may comprise disengaging means for canceling the locked state of the detector by the locking means as the housing is mounted on the panel.

The locking means preferably is on the detector and is resiliently deformable. The locking means comprises a locking piece that can pass through the mount hole together with the securing portion as the housing is mounted on the panel. The locking means also comprises a lock on the housing. The lock can hold the detector at the standby position by engaging the locking piece.

The disengaging means may be formed by the edge of the mount hole for resiliently deforming the locking piece while disengaging it from the locking portion as the housing is mounted.

The locking piece preferably is formed with a disengagement-guiding surface for guiding the locking piece in its deforming direction while being pushed by the edge of the mount hole.

The securing portion engages the panel and the locking piece is pushed by the edge of the mount hole during the process of mounting the housing on the panel. Thus, the locking piece is deformed resiliently and disengages from the lock as the securing portion and the locking piece first pass through the mount hole. At this time, the locking piece is deformed smoothly and resiliently by the edge of the mount hole due to the disengagement-guiding surface. Thereafter, the resilient lock passes through the mount hole and engages the panel.

The mount hole is an existing structure. Thus, the panel need not have a separate disengaging means and can have a simpler construction and lower production posts.

The invention also relates to a method of mounting a housing of a connector on a panel. The method comprises mounting the housing into a mount hole in the panel, holding the housing on the panel by a holding means, and detecting whether the housing is mounted properly on the panel by means of a detecting means.

The step of detecting preferably comprises moving a detector of the detecting means provided on one of the housing and the panel from a standby position to a detecting position. The method further comprises holding the detector at the standby position by a locking means.

The method may further comprise canceling the locked state of the detector by a disengaging means on the other of the housing and the panel, as the housing is mounted on the panel.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

A first embodiment of a connector according to the invention is intended for mounting on a door panel of an automotive vehicle and is described with reference to FIGS. 1 to 23. This connector has a male housing 20 that can be mounted to a mount hole H in a panel P by inserting the housing 20 into the mount hole H from the rear side of the panel P. The connector also has a female housing 10 that is connectable with the male housing 20 from the front side of the panel P. The mounting direction of the male housing 20 onto the panel P is referred to as the forward direction in the following description.

Figure 15:
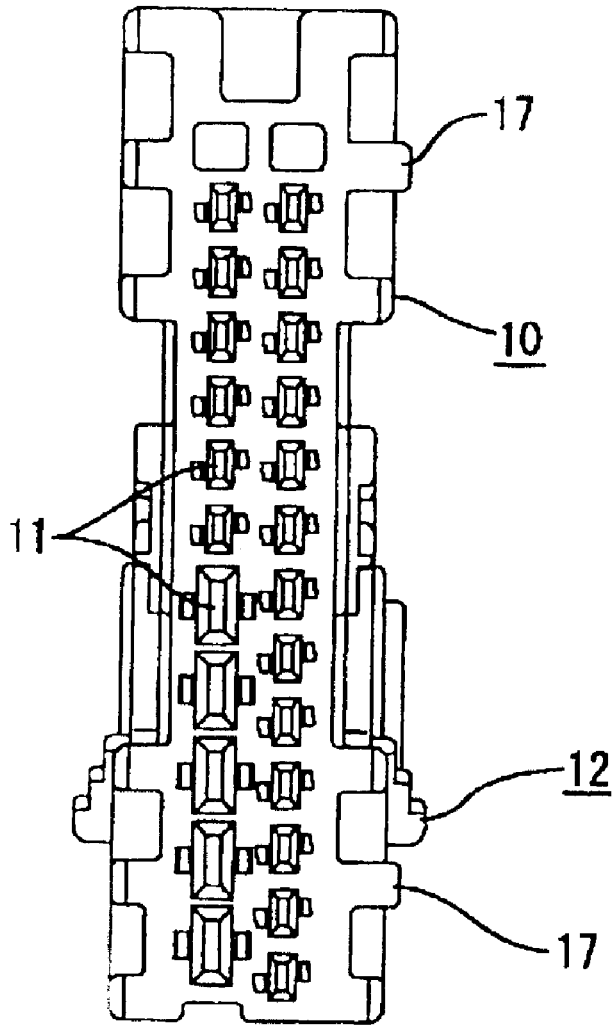
FIG. 15 is a front view of a female housing.
Figure 16:
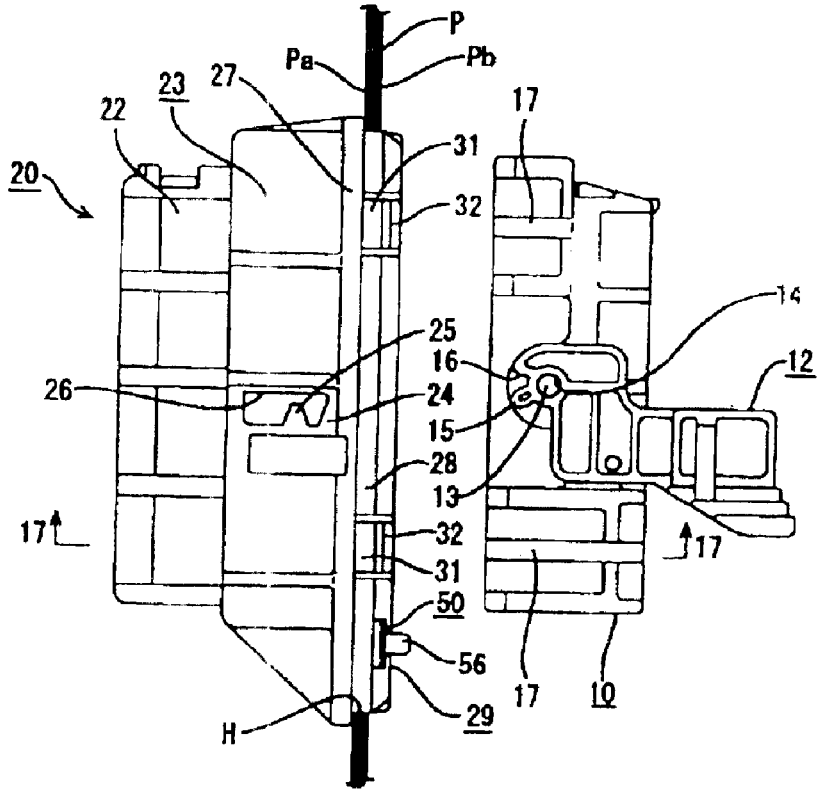
FIG. 16 is a side view showing the male housing mounted on the panel and the female housing having a lever mounted at an initial position.

The female housing 10 is made e.g. of a synthetic resin and, as shown in FIGS. 15 and 16, is substantially a block with cavities 11 for accommodating unillustrated female terminal fittings. The connector further has a U-shaped lever 12 and shaft pins 13 that project from the longer outer surfaces of the female housing 10. The shaft pins 13 pass through shaft holes 14 in the lever 12 so that the lever 12 can rotate relative to the female housing 10. A catch 15 and an engaging recess 16 are provided around each shaft hole 14 of the lever 12. Two slightly raised deformation-preventing portions 17 extend along forward and backward directions on the right outer surface in FIG. 15.

Figure 1:
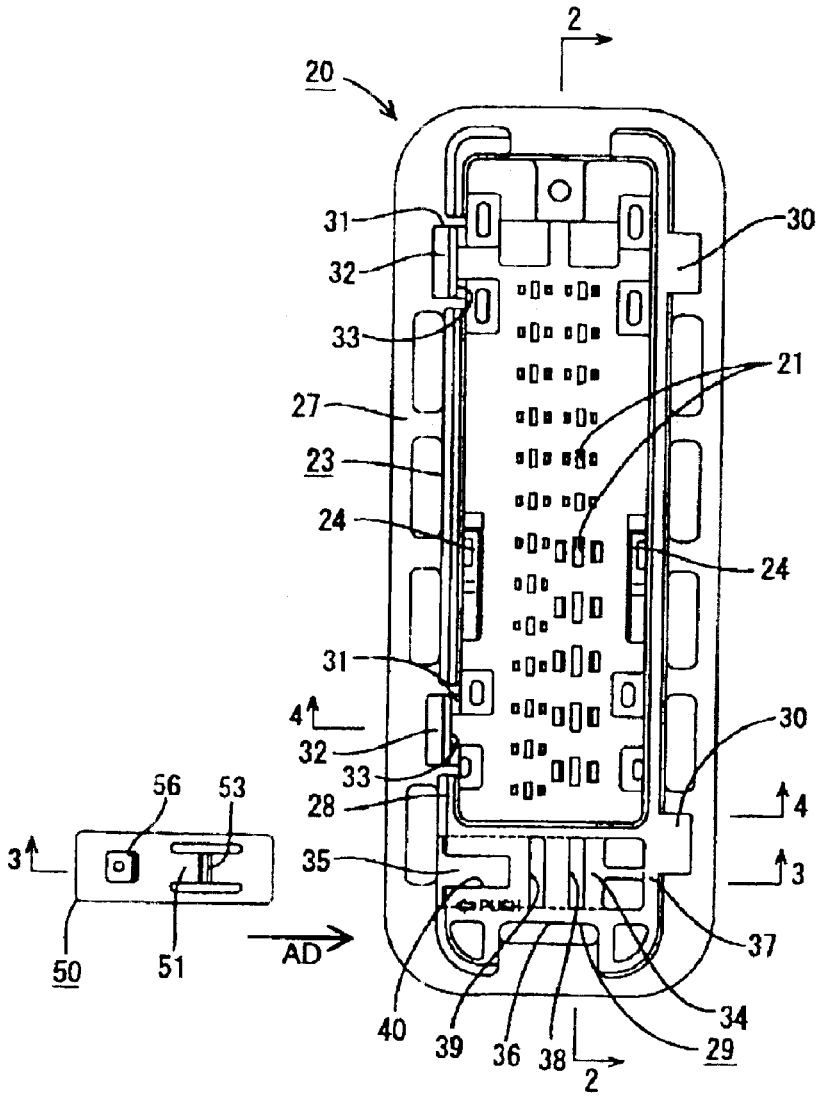
FIG. 1 is a front view of a male housing and a detector according to one embodiment of the invention.
Figure 2:
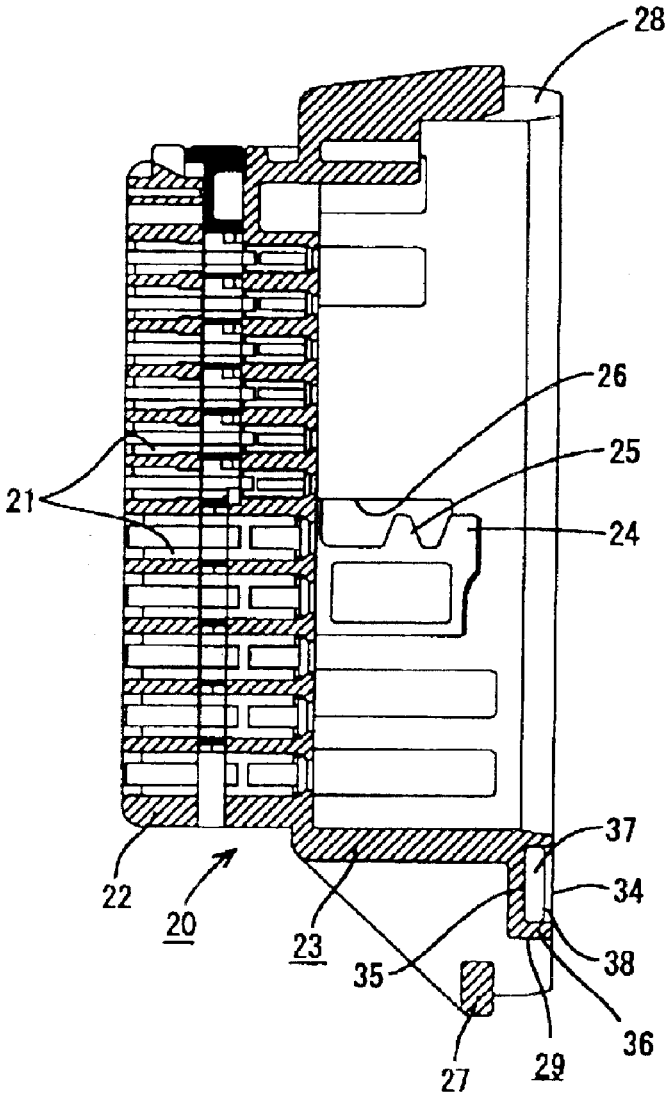
FIG. 2 is a section of the male housing along 2—2 of FIG. 1.

The male housing 20 is made e.g. of a synthetic resin and, as shown in FIGS. 1 and 2, has a terminal accommodating portion 22 with cavities 21 for accommodating male terminal fittings (not shown) at positions corresponding to the cavities 11 of the female housing 10. A substantially rectangular tubular receptacle 23 projects forward from the terminal accommodating portion 22 and the female housing 10 can be inserted into the receptacle 23 from the front. Receiving portions 24 and engaging projections 25 bulge one after the other on the longer inner surfaces of the receptacle 23 and engage respectively with the catches 15 and the engaging recesses 16 of the female housing 10. Mold-removing holes 26 are formed in the longer walls of the receptacle 23 and are used to remove a mold for forming the receiving portions 24 and the engaging projections 25 during the molding of the male housing 20. The mold removal holes 26 open sideways substantially normal to the connecting direction of the male and female housings 20, 10. A positional relationship between the receiving portions 24, the engaging projections 25 and the catches 15 and the engaging recesses 16 of the lever 12 can be seen from outside through the mold-removing holes 26.

A flange 27 bulges out on the outer surface of the receptacle 23 at a position slightly behind the front end. The flange 27 contacts a rear surface Pa of the panel P as the male housing 20 is mounted on the panel P. A penetrating portion 28 of the receptacle 23 projects forward from the flange 27 and projects through the mount hole H and to the front side of the panel P when the male housing 20 is mounted on the panel P. A detector-accommodating portion 29 is provided continuously at the lower side of the penetrating portion 28 in FIG. 1, and projects to the front side of the panel P together with the penetrating portion 28 by being passed through the mount hole H. The flange 27 also substantially surrounds the detector-accommodating portion 29.

Figure 4:
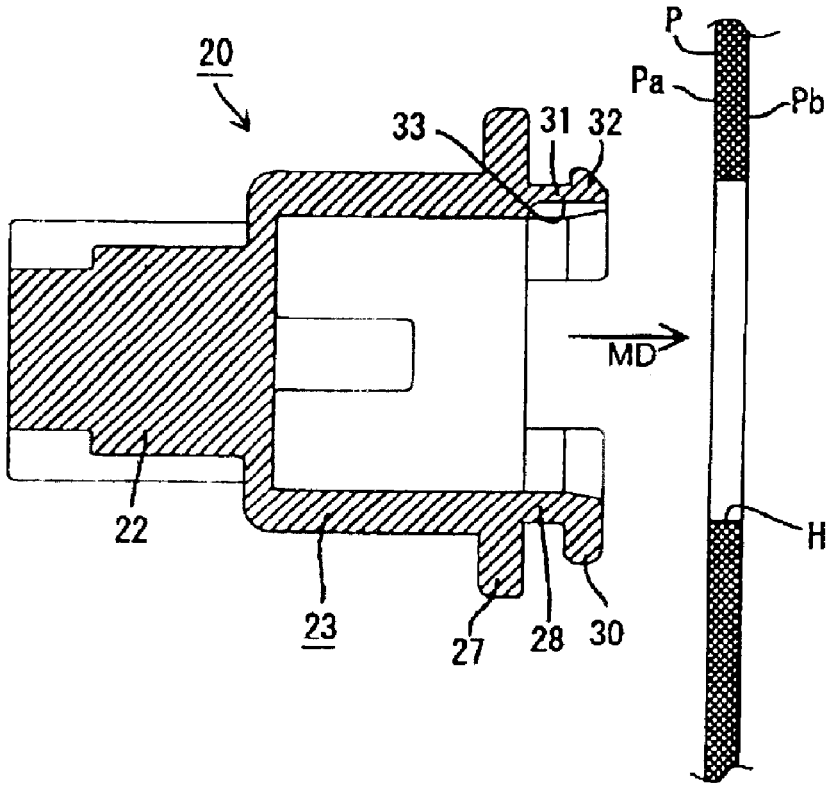
FIG. 4 is a section of the male housing and panel along 4—4 of FIG. 1.

Two securing portions 30 bulge out to face the flange 27 at the outer surface of the front end of the right longer wall of the penetrating portion 28 in FIG. 1, and two cantilevered resilient locks 31 are formed by slits in the left longer wall of the penetrating portion 28 in FIG. 1. The locks 31 are resiliently deformable inward parallel to the shorter sides of the male housing 20, and a locking claw 32 projects from the outer surface of the front end of each resilient lock 31 and faces the flange 27, as shown in FIG. 4. Front surfaces of the resilient locks 31 and the locking claws 32 are slanted up and to the back.

Figure 6:
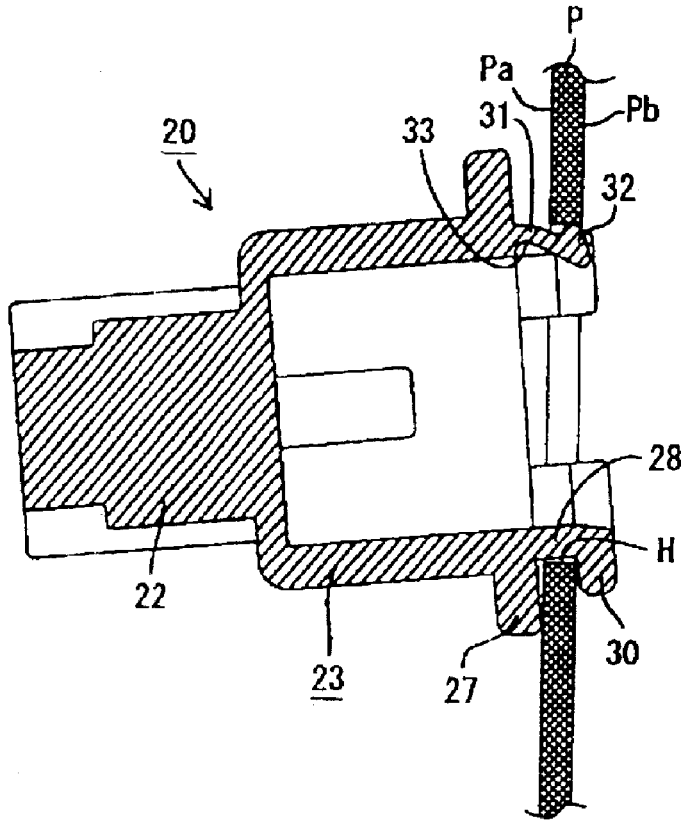
FIG. 6 is a section similar to FIG. 4, but showing an intermediate stage of mounting the male housing on the panel.

The slanted surfaces of the resilient locks 31 engage the rear edge of the mount hole H and guide the resilient locks 31 through an inward deformation as the male housing 20 is being mounted to the panel P (see FIG. 6). The securing portions 30 and the locking claws 32 of the resilient locks 31 pass through the mount hole H and engage the front surface Pb of the panel P to hold the panel P tightly between the locking claws 32 and the flange 27 (see FIG. 8). The securing portion 30 and the resilient lock 31 at the upper side in FIG. 1 are substantially at the same height. However, the securing portion 30 at the lower side is coupled to the detector-accommodating portion 29 and the resilient lock 31 at the lower side is above the lower securing portion 30.

A groove 33 is formed in the inner surface of each resilient lock 31 to facilitate the resilient deformation of the resilient lock 31. The entrance of the deformation preventing portions 17 of the female housing 10 into the grooves 33 is permitted when the resilient locks 31 are in an unbiased state, whereas the entrance of the deformation preventing portions 17 is prevented when the resilient locks 31 are deformed inward. Entry of the deformation preventing portions 17 into the grooves 33 prevents resilient deformation of the resilient locks 31 (see FIG. 21). A specified space inside each resilient lock 31, including the groove 33, defines a deformation space for permitting the resilient deformation of the resilient lock 31.

Figure 3:
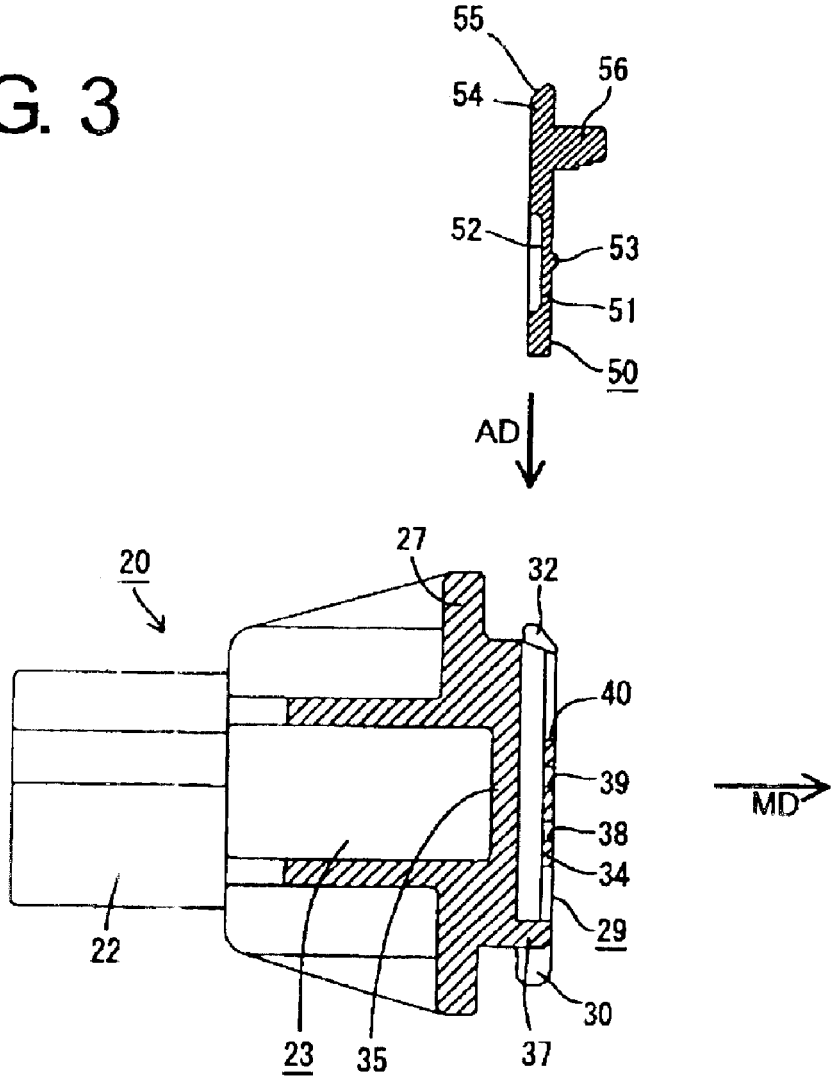
FIG. 3 is a section along 3—3 of FIG. 1.

As shown in FIGS. 1 and 3, the detector-accommodating portion 29 has two front and rear walls 34, 35 bulging out from the shorter sides of the penetrating portions 28 substantially along the longer sides thereof. The bottom ends and right ends of the walls 34, 35 in FIG. 1 are coupled by a side wall 36 and a stop wall 37, whereby the detector-accommodating portion 29 is substantially a bottomed hole that opens leftward in FIG. 1. When the male housing 20 is mounted on the panel P, the front wall 34 of the detector-accommodating portion 29 projects from the front side Pb of the panel P, whereas the front surface of the rear wall 35 is substantially flush with the front surface Pb of the panel P (see FIG. 9).

A substantially plate-shaped detector 50 is accommodated in the detector accommodating portion 29 and is movable left and right in FIG. 1 and up and down in FIG. 3 along the accommodating direction AD. The accommodating direction AD is substantially parallel to the shorter sides of the male housing 20 and hence substantially normal to the mounting direction MD of the male housing 20 onto the panel 20. Two slits extend substantially along the accommodating direction AD of the detector 50 to define a resiliently deformable holding arm 51 that is supported at both ends. A groove 52 is formed in the rear surface of the holding arm 51 to facilitate resilient deformation of the holding arm 51, and a holding projection 53 is provided on the front surface of the holding arm 51. The detector 50 can be held at a standby position shown in FIGS. 9 and 10 and a detecting position shown in FIGS. 11 and 12 by engaging the holding projection 53 with a standby position holding hole 38 and a detecting position holding hole 39 formed in the front wall 34 of the detector accommodating portion 29. Opposite surfaces of the holding projection 53 that engage the holding holes 38, 39 are slanted or rounded, and hence converge. Thus, a force of at least a specified intensity applied to the detector 50, causes the holding projection 53 to deform the holding arm 51 sufficiently for the holding projection 53 to disengage from the holding hole 38 or 39 so that the detector 50 can move along the accommodating direction AD.

Figure 9:
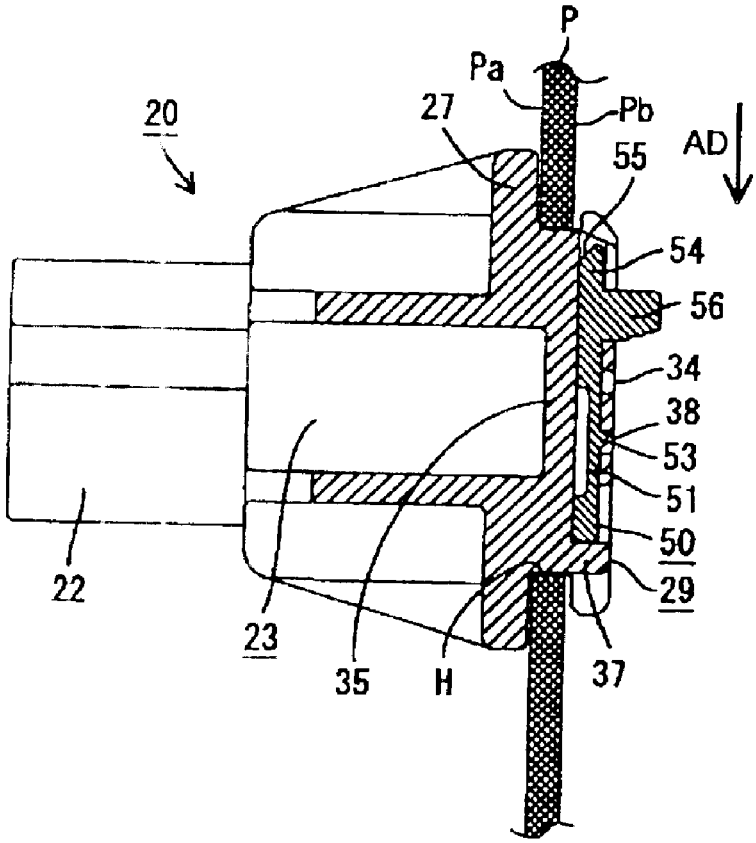
FIG. 9 is a section similar to FIG. 3, but showing the state where the male housing is properly mounted on the panel.
Figure 10:
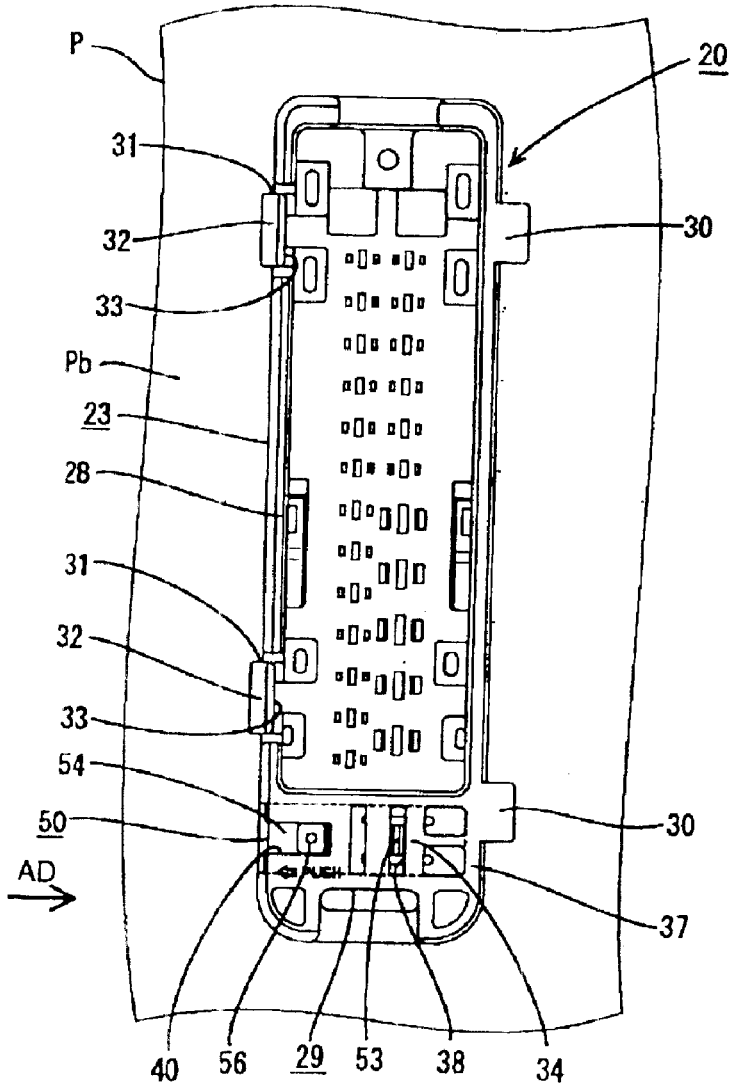
FIG. 10 is a front view showing the state where the male housing is properly mounted on the panel.

The detector 50 at the standby position is completely in the detector accommodating portion 29, as shown in FIGS. 9 and 10, and is prevented from moving in the accommodating direction AD by the stop wall 37. On the other hand, a detecting portion 54 of the detector 50 in FIG. 12 projects out from the detector accommodating portion 29 when the detector 50 is at the detecting position shown in FIGS. 11 and 12. The detecting portion 54 is entirely on the front side of the panel P when the male housing 20 is mounted properly on the panel P, but is in the mount hole H at an intermediate stage of mounting the male housing 20 on the panel P. Thus, the inner surface Hs of the mount hole H prevents the detector 50 from moving to the detecting position before the male housing 20 is mounted properly (see FIG. 13). On the other hand, the detector 50 can move to the detecting position when the male housing 20 is mounted properly on the panel P. At this detecting position, the detecting portion 54 engages the front surface Pb of the panel P at the side of the resilient locks 31 and opposite from the securing portions 30. Thus, the panel P is held tightly between the detecting portion 54 and the flange 27.

A guide surface 55 is formed at the rear side of the leading end of the detecting portion 54 and slopes back and in the accommodating direction AD, as shown in FIG. 3. The guide surface 55 contacts the front edge of the mount hole H if an attempt is made to move the detector 50 toward the detecting position when only the front end of the detecting portion 54 projects toward the front side of the panel P (see FIG. 14). The guide surface 55 slides in contact with the front edge of the mount hole H and guides the male housing 20 to a proper mounting posture as the detector 50 is moved further towards the detecting position.

As shown in FIGS. 1 and 3, an operable portion 56 projects forward between the holding arm 51 and the detecting portion 54 on the front surface of the detector 50 and is used to move the detector 50. The operable portion 56 projects forward through a slot 40 in the front wall 34 when the detector 50 in the detector accommodating portion 29 and projects to the front side of the panel P when the male housing 20 is mounted on the panel P. Accordingly, the detector 50 can be moved by pushing the operable portion 56 from the front side of the panel P. The bottom surface of the operable portion 56 in FIG. 3 is stepped so that a finger or the like can be placed easily during the operation.

Figure 5:
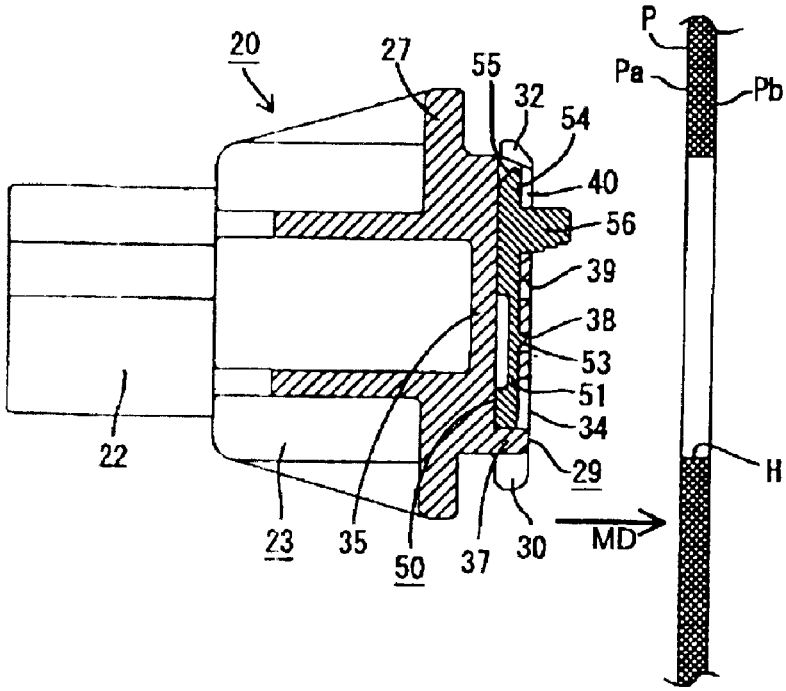
FIG. 5 is a section similar to FIG. 3, but showing the panel and the male housing having the detector mounted at a standby position.

The detector 50 initially is mounted at the standby position in the detector accommodating portion 29, and the male housing 20 is mounted on the panel P from the rear side of the panel P, as shown in FIGS. 4 and 5. Only a small operation space may exist at the rear side of the panel P of the door. However, an operator at the front side of the panel P can bring his hand to the rear side of the panel P and may grab the male housing 20 around the panel P to perform this mounting operation.

Figure 7:
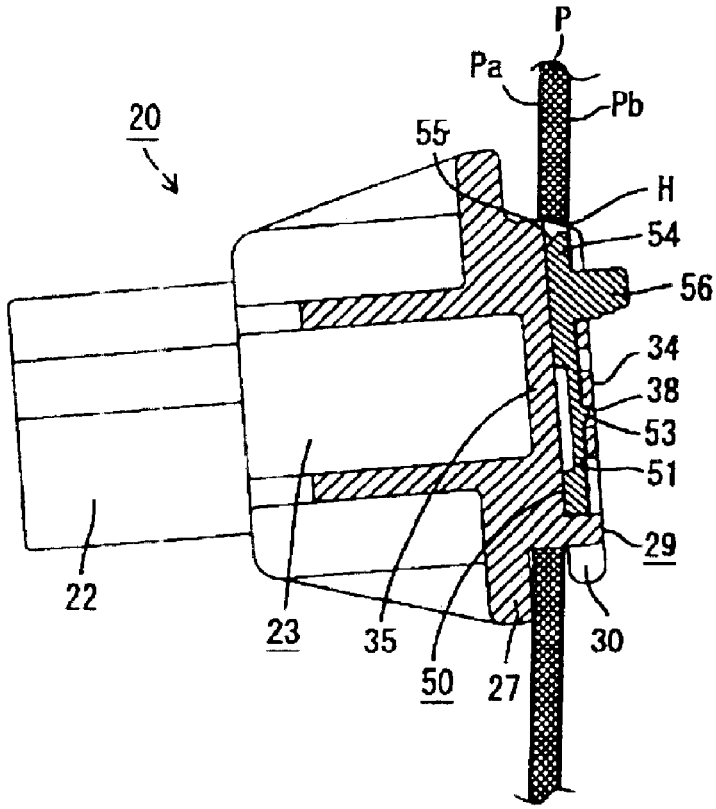
FIG. 7 is a section similar to FIG. 3, but showing the intermediate stage of mounting the male housing on the panel.
Figure 8:
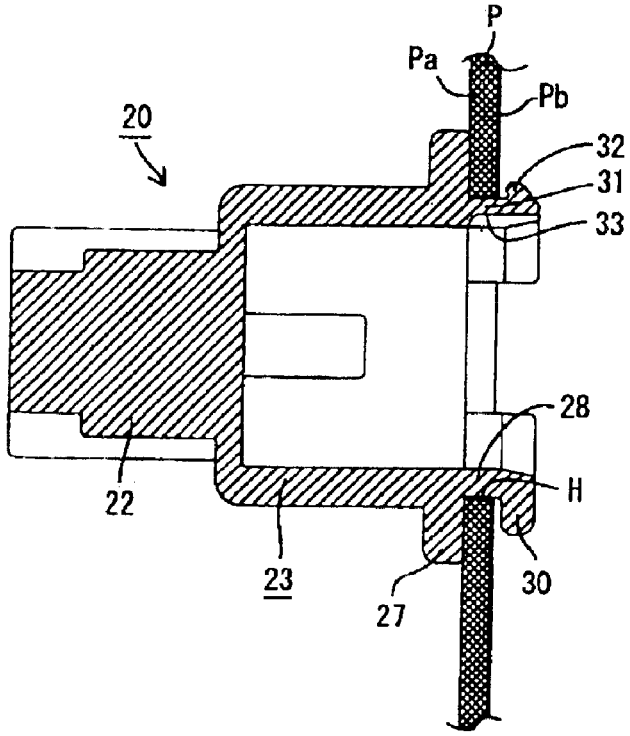
FIG. 8 is a section similar to FIG. 4, but showing a state where the male housing is properly mounted on the panel.

Mounting is carried out by inclining the male housing 20 so that the shorter sides thereof extend obliquely to the panel P. Both securing portions 30 then are passed in the mounting direction MD through the mount hole H and engage the front surface Pb of the panel P. The male housing 20 then is rotated about the securing portions 30 and into a vertical posture. Thus, the slanted surfaces of the resilient locks 31 engage the rear edge of the mount hole H and resiliently deform sufficiently for locks 31 to be pushed through the mount hole H, as shown in FIG. 6. In this process, the detector 50 is at the standby position and can pass through the mount hole H, as shown in FIG. 7. The male housing 20 eventually reaches a substantially vertical posture with the flange 27 substantially parallel to the panel P, and the entire front surface of the flange 27 substantially contacts the rear surface Pa of the panel P. Simultaneously, the locking claws 32 pass completely through the mount hole H. Thus, the locks 31 resiliently restore and the locking claws 32 engage the front surface Pb of the panel P, as shown in FIG. 8. In this way, the male housing 20 is held properly mounted on the panel P with the panel P held tightly between the flange 27 and both the securing portions 30 and the locking claws 32 of the resilient locks 31.

Figure 11:
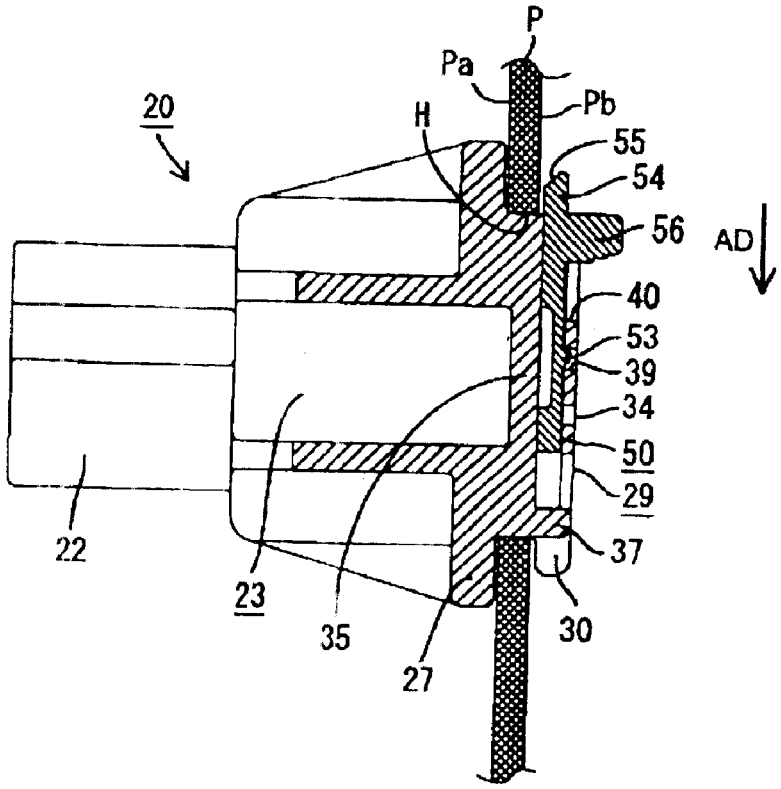
FIG. 11 is a section similar to FIG. 3, but showing a state reached by moving the detector to a detecting position.
Figure 12:
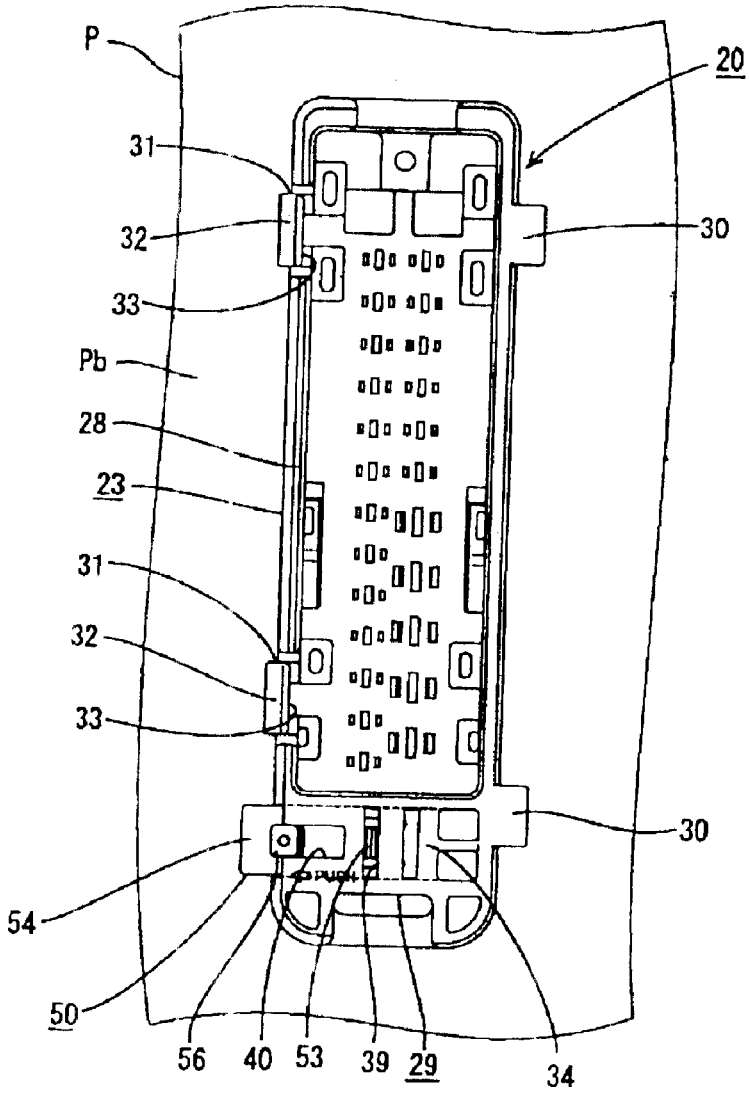
FIG. 12 is a front view showing the state reached by moving the detector to the detecting position.
Figure 13:
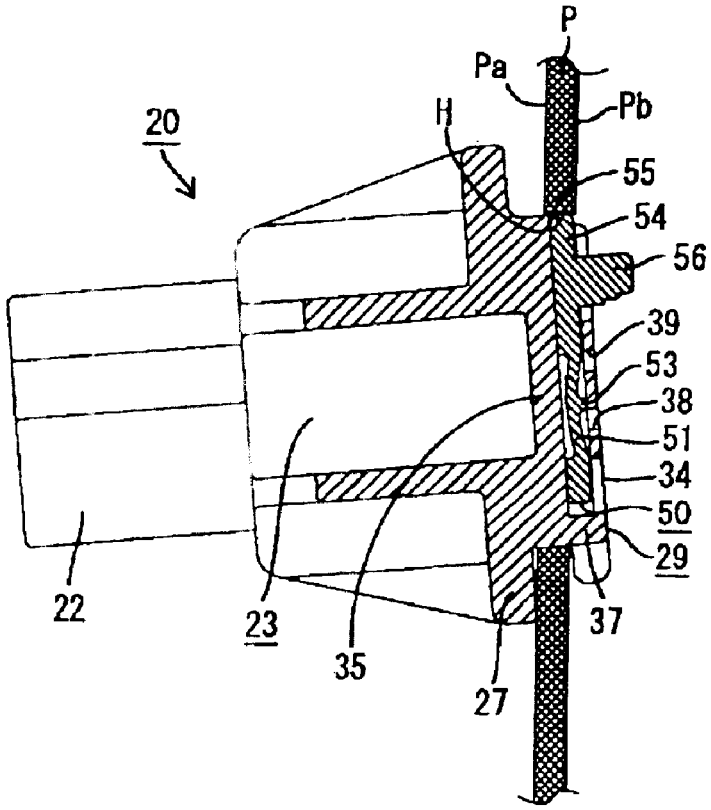
FIG. 13 is a section similar to FIG. 3, but showing a state where a detecting portion interferes with the inner surface of a mount hole.

At this stage, the penetrating portion 28 and the detector-accommodating portion 29 have passed through the mount hole H, and the front surface of the rear wall 35 is substantially flush with the front surface Pb of the panel P. Additionally, the detector 50 is completely through the mount hole H and is at the front side of the panel P, as shown in FIGS. 9 and 10. The operable portion 56 then is pushed from the front side of the panel P to move the detector 50 substantially opposite to the accommodating direction AD and to the detecting position. The detector 50 can be moved to the detecting position, as shown in FIGS. 11 and 12, because the detecting portion 54 does not interfere with the inner surface Hs of the mount hole H. In this way, the properly mounted state of the male housing 20 on the panel P can be confirmed. At the detecting position, the detecting portion 54 engages the front surface Pb of the panel P at the side of the resilient locks 31 and opposite the securing portions 30. The detecting portion 54 remains engaged with the panel P even if the resilient locks 31 are deformed inadvertently by interference from another part and disengaged from the panel P. Thus, the detecting portion 54 and the securing portions 30 firmly hold the male housing 20 on the panel P.

The operator may incorrectly believe that the male housing 20 is mounted properly despite the fact that the male housing 20 is mounted as shown in FIG. 7. However, the detector 50 cannot be moved to the detecting position from the FIG. 7 orientation because the detecting portion 54 contacts the inner peripheral surface Hs of the mount hole H. Thus, the operator knows that the male housing 20 is not yet completely mounted, and the operator tries again to mount the male housing 20 properly. In this way, the mounted state of the male housing 20 on the panel P can be detected based on whether the detector 50 can be moved to the detecting position.

Figure 14:
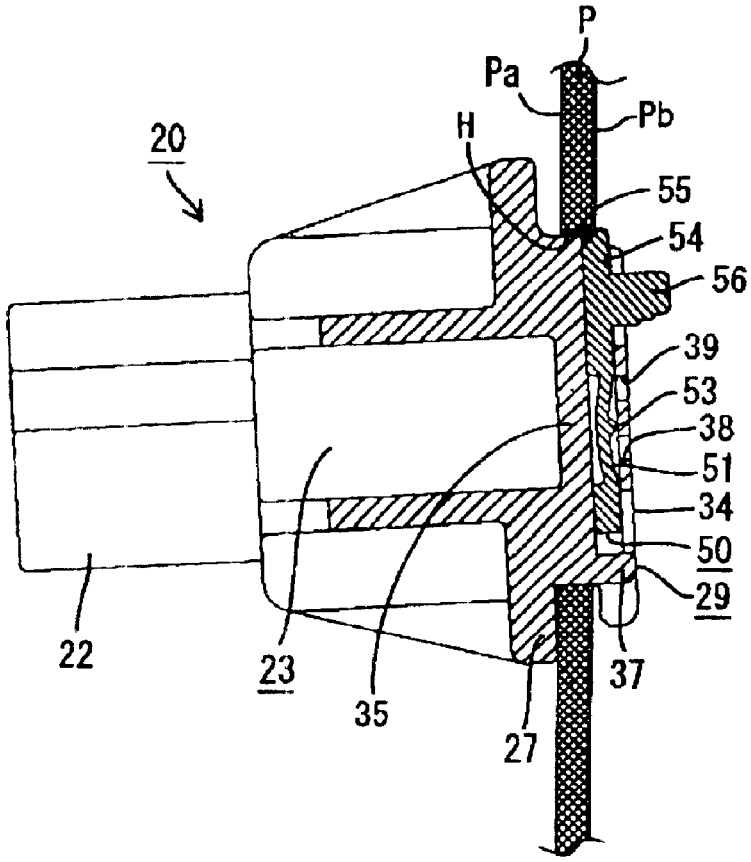
FIG. 14 is a section similar to FIG. 3, but showing a state where a guide surface is in contact with the front edge of the mount hole.

The front end of the detecting portion 54 projects to the front side of the panel P immediately before the male housing 20 is mounted properly on the panel P. Thus, an attempt to move the detector 50 to the detecting position at this alignment brings the guide surface 55 into sliding contact with the front edge of the mount hole H, as shown in FIG. 14. Accordingly, the male housing 20 is pulled substantially in the moving direction MD by the sliding contact of the guide surface 55 and the front edge of the mount hole H, and the posture of the male housing 20 is corrected to the proper mounting posture shown in FIG. 1. In such a case, operability is good since it is not necessary to mount the male housing 20 again.

Figure 17:
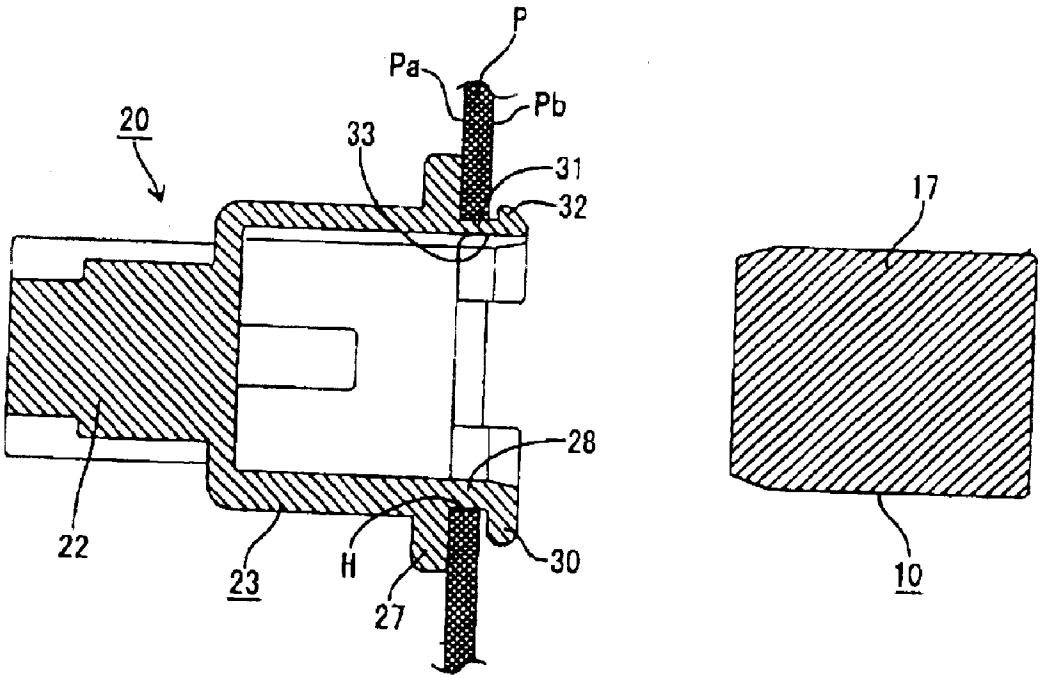
FIG. 17 is a section along 17—17 of FIG. 16.
Figure 18:
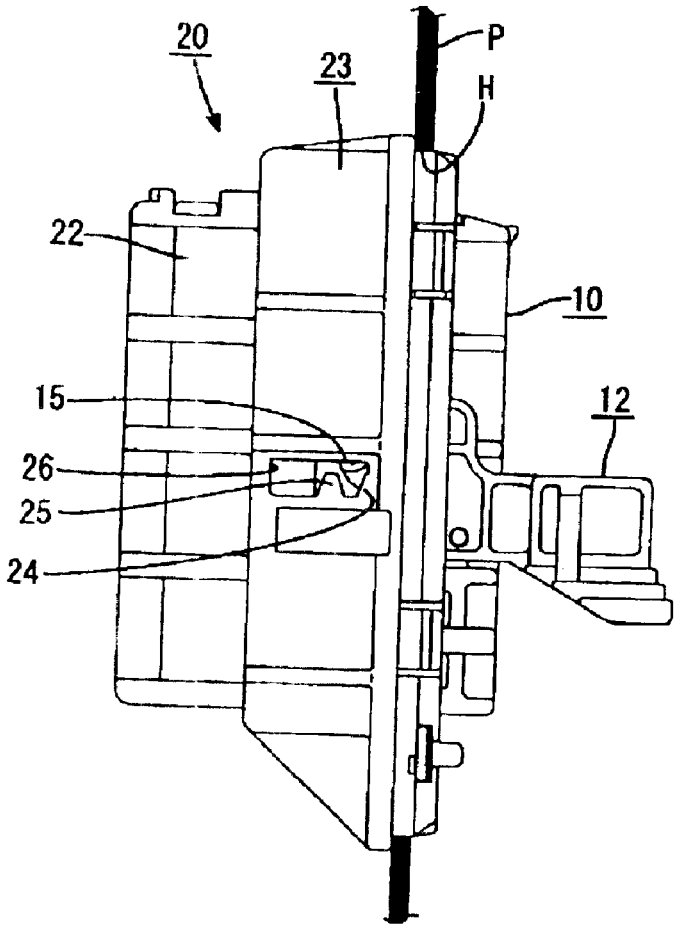
FIG. 18 is a side view showing a state where the male and female housings are connected to a specified depth.
Figure 19:
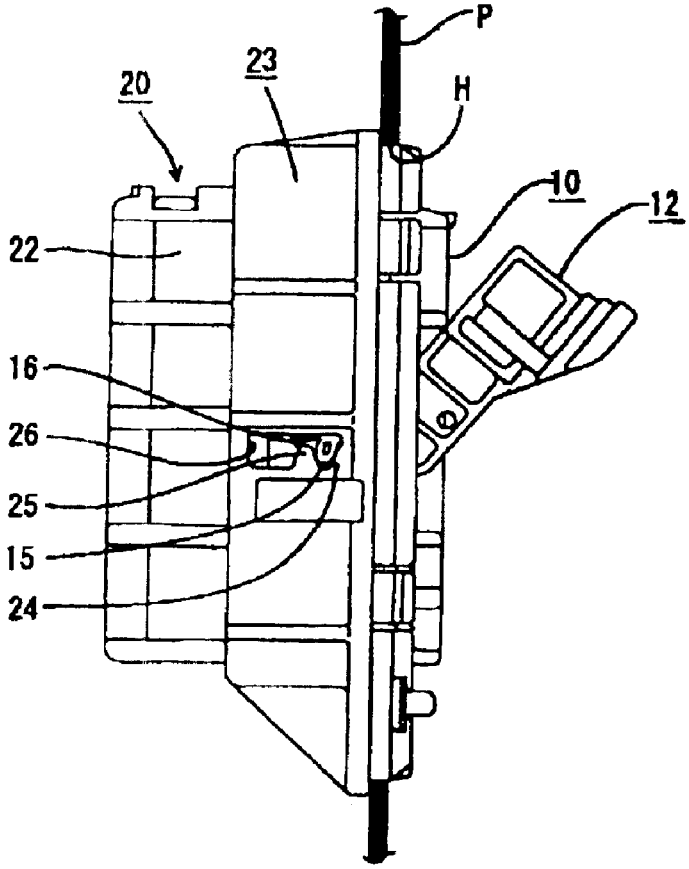
FIG. 19 is a side view at an intermediate stage of rotating the lever.
Figure 20:
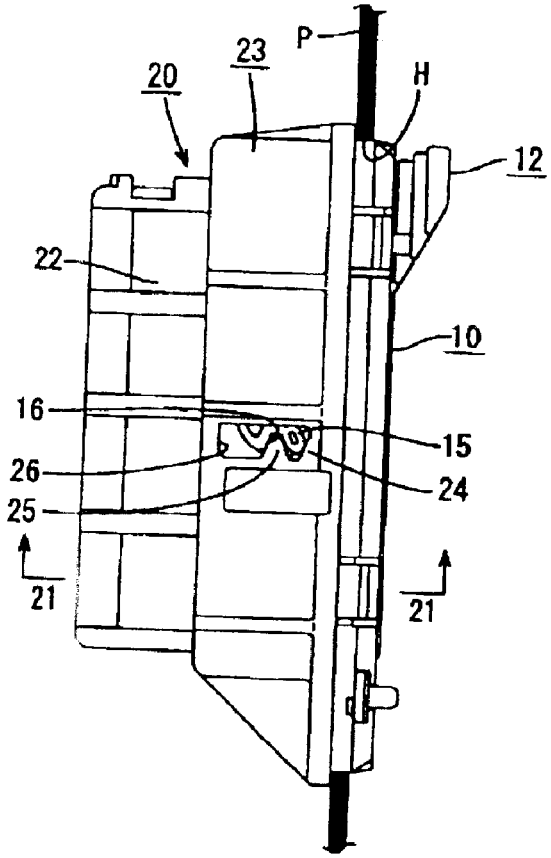
FIG. 20 is a side view showing a state reached by rotating the lever to a connection position.
Figure 21:
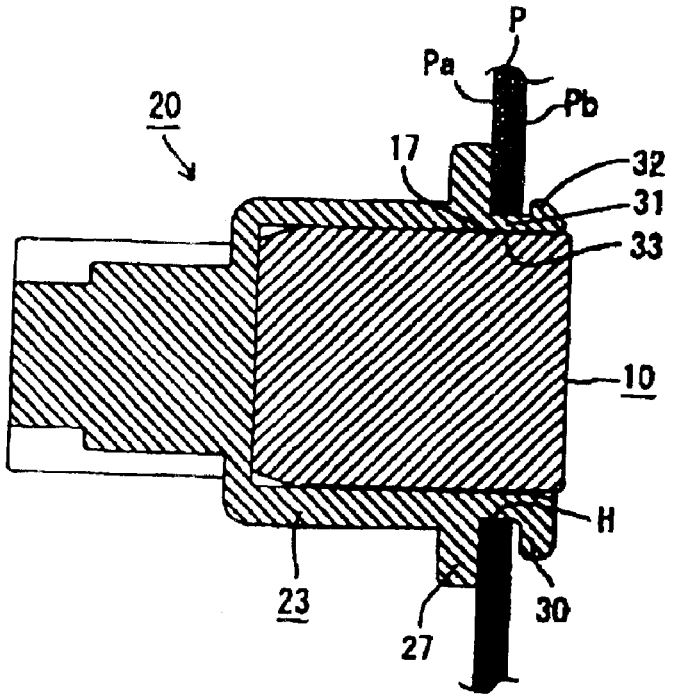
FIG. 21 is a section along 21—21 of FIG. 20.
Figure 22:
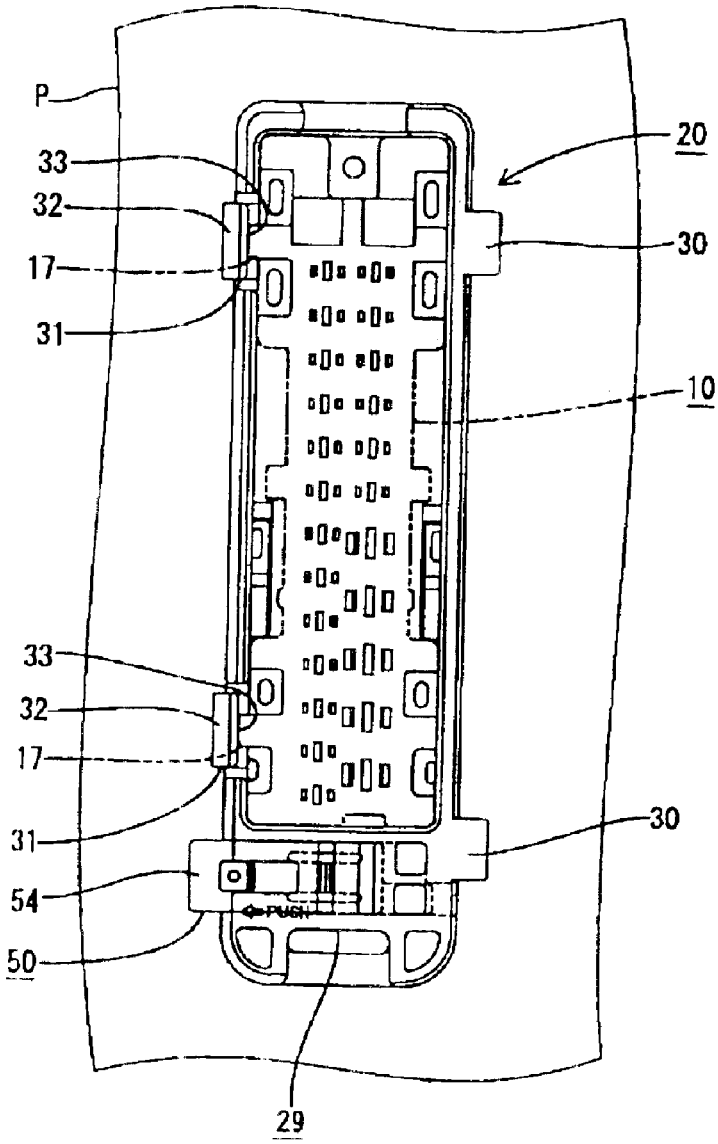
FIG. 22 is a front view showing a state where the female housing is connected with the male housing mounted on the panel.

The female housing 10 is connected from the front side of the panel P, as shown in FIGS. 16 and 17, after the male housing 20 is mounted on the panel P. As shown in FIG. 18, the female housing 10 is fit to specified depth in the receptacle 23 and the lever 12 is rotated counterclockwise from the initial position. Rotation of the lever 12 causes the catches 25 to engage the receiving portions 24, as shown in FIG. 19. Thus, the two housings 10, 20 are connected gradually by the lever action. The two housings 10, 20 are connected to proper depth when the lever 12 reaches the connection position shown in FIG. 20, and are locked in their properly connected state by the engagement of the engaging projections 25 with the engaging recesses 16. In this process, the deformation preventing portions 17 of the female housing 10 enter the grooves 33 at the inner sides of the resilient locks 31, as shown in FIGS. 21 and 22, and prevent deformation of the resilient locks 31. Accordingly, the male housing 20 can be held firmly on the panel P when the two housings 10, 20 are connected properly.

The male housing 20 may be mounted on the panel P with the longer sides inclined. However, the detector 50 is at only one end of the longer side of the male housing 20 due to a small mounting space or other factors. Thus, there is a possibility that the side of the male housing 20 with the detector 50 is mounted properly to enable the movement of the detector 50 to the detecting position, while the opposite side of the male housing 20 is mounted incompletely. In other words, there is a possibility that the locking claw 32 of the resilient lock 31 closer to the detector 50 is engaged with the panel P while the other resilient lock 31 is still deformed.

Figure 23:
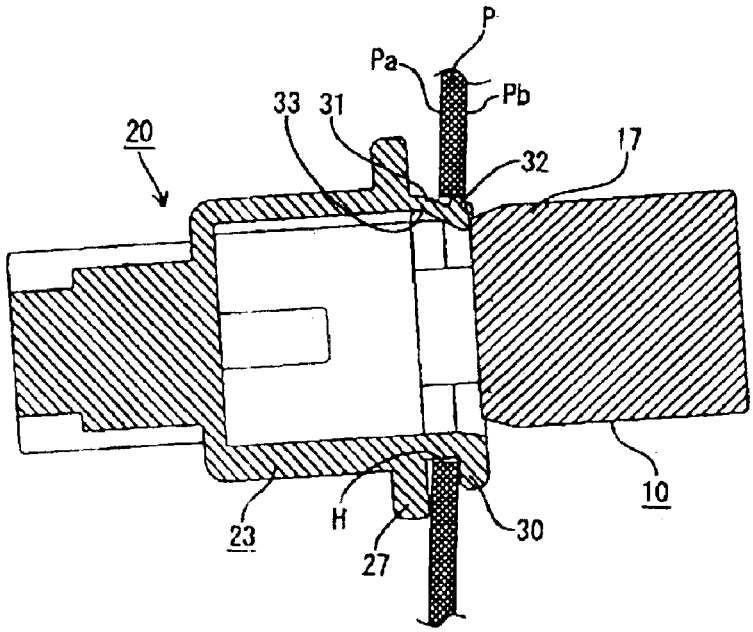
FIG. 23 is a section showing a state where a deformation preventing portion of the female housing abuts against a deformed resilient lock.

An attempt could be made to connect the female housing 10 with such an incompletely mounted male housing 20. However, the deformed resilient lock 31 is in the mount hole H. Therefore, the deformation preventing portion 17 contacts the resilient lock 31, as shown in FIG. 23, and prevents connection of the two housings 10, 20. This informs the operator that the male housing 20 is not mounted properly on the panel P. Thus, the male housing 20 is remounted and the female housing 10 is connected again. In this way, the mounted state of the male housing 20 on the panel P can be detected based on whether the housings 10, 20 can be connected with each other. Conversely, connection of the two housings 10, 20 guarantees that the male housing 20 is mounted properly on the panel P.

As described above, the mounted stated of the male housing 20 on the panel P can be detected based on whether the detector 50 can be moved to the detecting position.

The inner peripheral surface Hs of the mount hole H is a preventing portion that prevents movement of the detecting portion 54 of the detector 50. Thus, the panel P can have a simpler construction and lower production posts, as compared to a case where the panel P has a separate preventing portion.

The detecting portion 54 engages the front surface Pb of the panel P when the detector 50 reaches the detecting position. As a result, the male housing 20 can be held firmly on the panel P. Further, the detecting portion 54 is at the side of the panel P with the resilient locks 31 and remains engaged with the panel P even if the resilient lock 31 is disengaged inadvertently from the panel P. Therefore, the male housing 20 can be held stably on the panel P.

An operator at the front side of the panel P may have to mount the male housing from the rear side of the panel P through the panel P due to a limited operation space or other factors. However, such a mounting operation can be performed while the operable portion 56 of the detector 50 is seen from the front side of the panel P, which is from the side of the operator. If the operable portion 56 was at the rear side of the panel, it could not be seen and the state of the operation would depend mostly on the feeling of the operator's fingertips. As compared to such a case, the operability of the detector 50 is improved by this embodiment.

The detector 50 is formed with the guide surface 55. Thus, the posture of the male housing 20 is corrected to the proper mounting posture by pushing the detector 50 to the detecting position, immediately before the male housing 20 reaches its properly mounted state on the panel P. Thus, operability is good.

The deformation preventing portions 17 of the female housing 10 enter the grooves 33 at the inner sides of the resilient locks 31 of the male housing 20 if the male housing 20 is mounted properly on the panel P. On the other hand, the deformation preventing portions 17 contact the deformed resilient locks 31 and cannot enter the grooves 33 if the male housing 20 is left partly mounted on the panel P, thereby hindering connection of the two connectors 10, 20. Accordingly, the mounted state of the male housing 20 on the panel P can be detected based on whether the two connectors 10, 20 can be connected with each other. Further, deformation of the resilient locks 31 is prevented by the deformation preventing portions 17 in the properly connected state of the two connectors 10, 20, and the male housing 20 is held stably on the panel P.

A second embodiment of the invention is described with reference to FIGS. 24 to 36. Identical or similar elements and features as in the previous embodiment are denoted with the same reference numerals so that a repetitive description thereof is omitted hereinafter.

Figure 24:
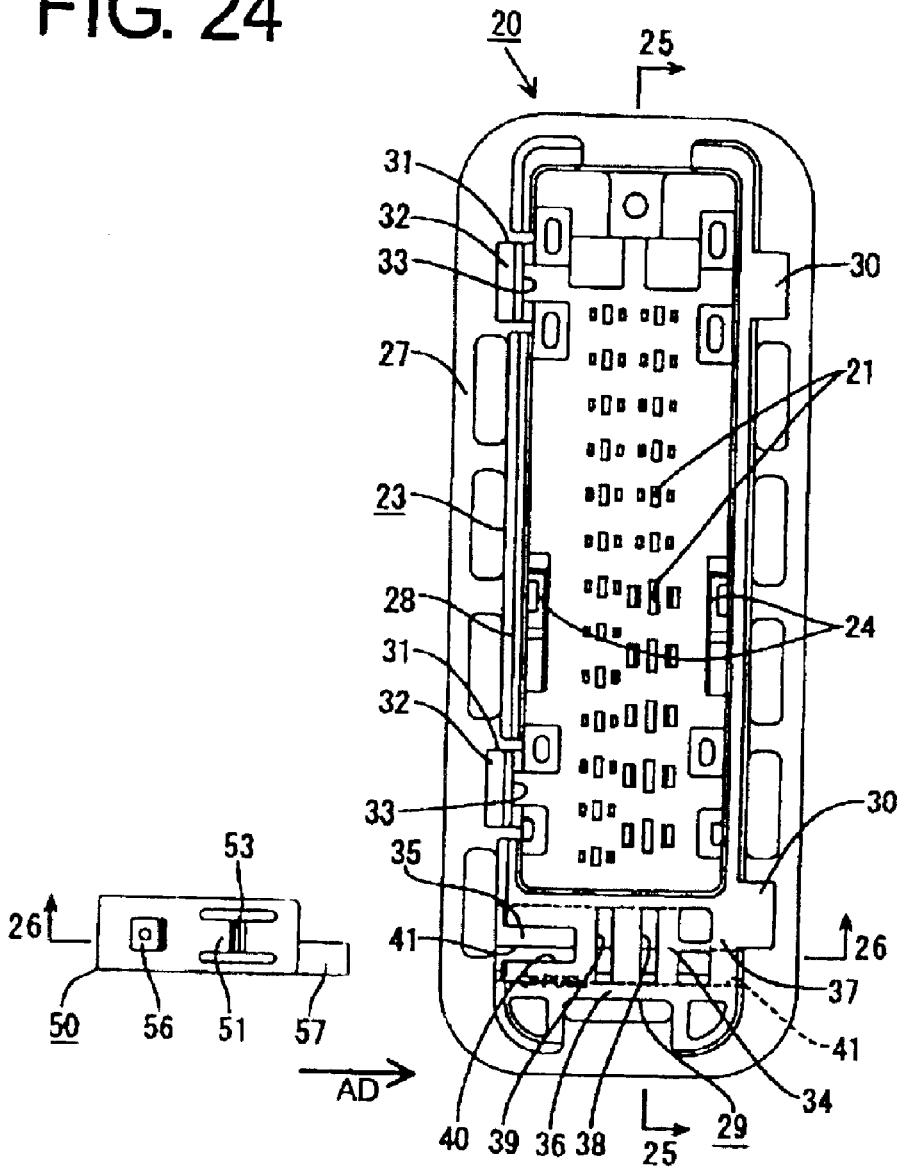
FIG. 24 is a front view of a male housing and a detector according to another embodiment of the invention.
Figure 25:
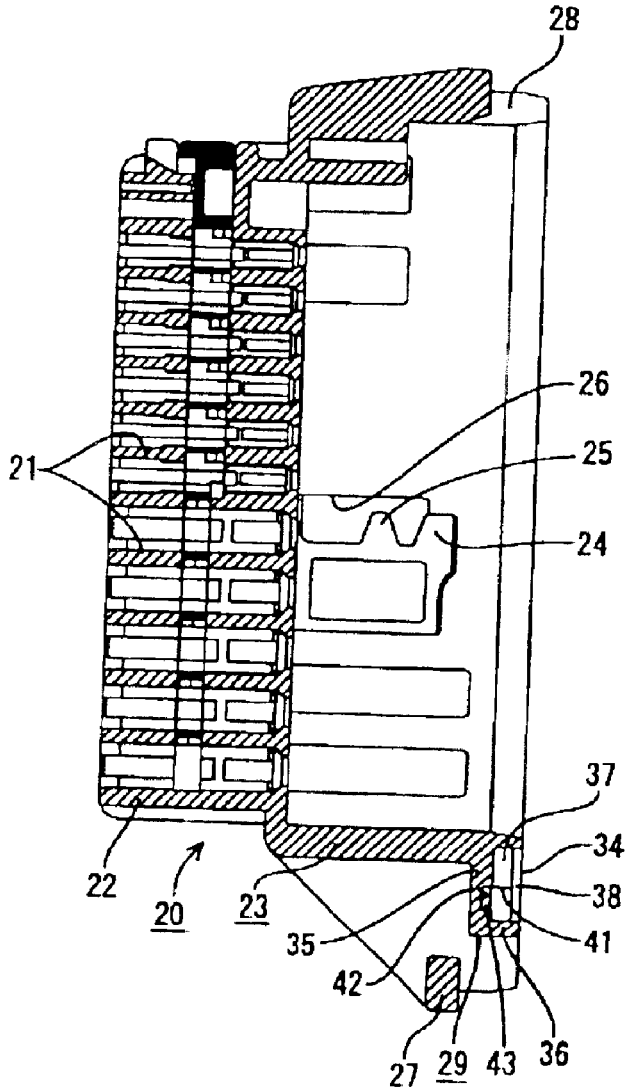
FIG. 25 is a section of the male housing along 25—25 of FIG. 24.
Figure 26:
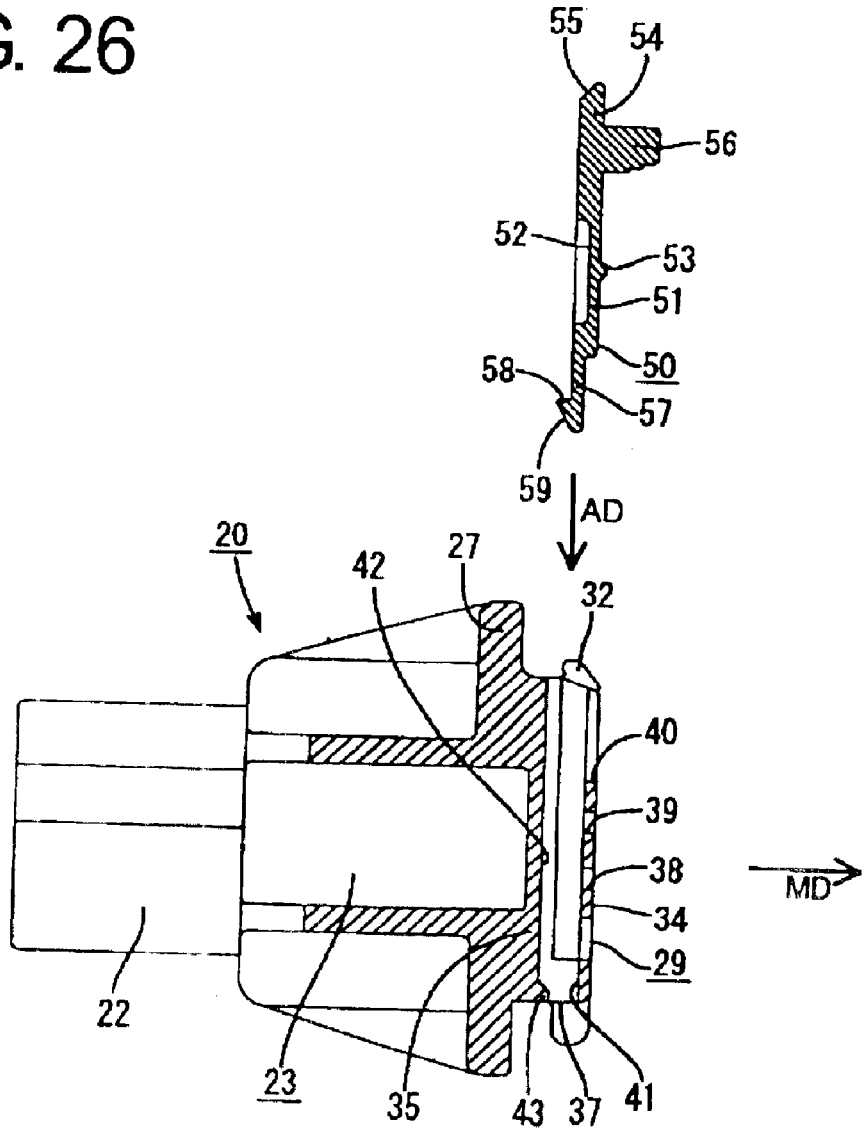
FIG. 26 is a section along 26—26 of FIG. 24.

As shown in FIGS. 24 and 26, a resiliently deformable locking piece 57 is cantilevered from an end of the detector 50 substantially opposite from the detecting portion 54. The locking piece 57 is about half the width and thickness of the detector 50 and is at the front side of the detector 50 with respect to the accommodating direction AD in FIG. 24. A hook-shaped locking claw 58 is formed at the rear surface of the leading end of the locking piece 57 and projects back in a direction substantially opposite to the mounting direction MD. A front half of the stop wall 37 of the detector accommodating portion 29 is cut away to define an insertion hole 41 that permits insertion of the locking piece 57, as shown in FIG. 24. The rear wall 35 of the detector-accommodating portion 29 has an entrance-permitting groove 42 for permitting the entrance of the locking claw 58. The entrance-permitting groove 42 extends along the shorter side of the male housing 20 and is open toward the side where the detector 50 is to be mounted in FIG. 24. A locking portion 43 is formed in the rear wall 35 at the right side of the entrance-permitting groove 42 in FIG. 24 and engages the locking claw 58.

The locking claw 58 is inserted into the entrance-permitting groove 42 and the locking piece 57 is inserted into the insertion hole 41 during the process of mounting the detector 50 to the standby position. A surface of the locking portion 43 facing the entrance-permitting groove 42 is slanted to deform the locking piece 57 and to guide the locking claw 58 over the locking portion 43. The locking piece 57 projects through the insertion hole 41 and out from the detector-accommodating portion 29 when the detector 50 reaches the standby position. The locking piece 57 then restores resiliently so that the locking claw 58 engages the outer surface of the locking portion 43 to prevent loose movement of the detector 50 in a direction substantially opposite to the accommodating direction AD. Locking surfaces of the locking portion 43 and the locking claw 58 both extend substantially normal to moving directions AD of the detector 50. Thus, the detector 50 can be held firmly at the standby position with a locking force larger than the force given by the engagement of the holding projection 53 and the standby position holding hole 38.

Figure 29:
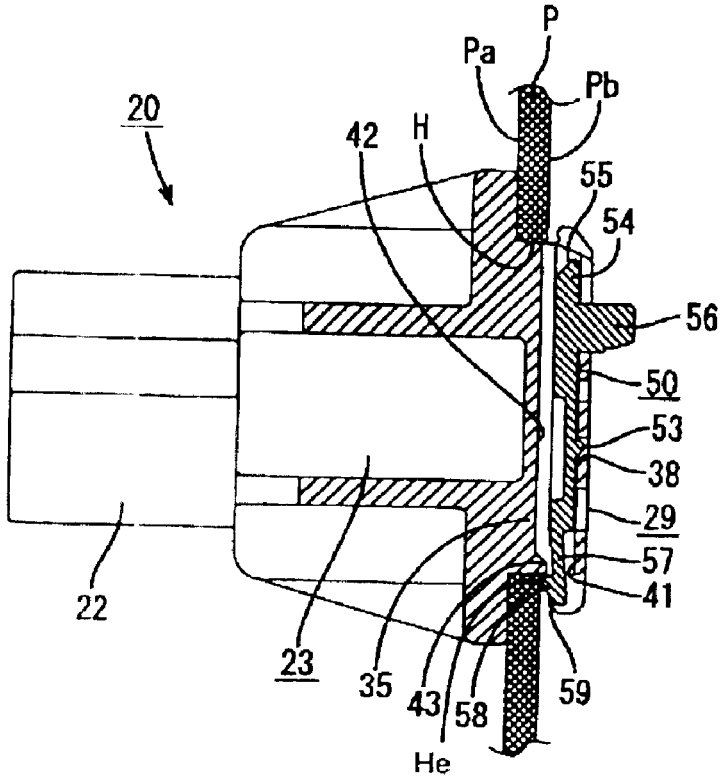
FIG. 29 is a section similar to FIG. 26, but showing the state where the male housing is properly mounted on the panel.

The locking claw 58 at the standby position is substantially adjacent the securing portion 30 and opposed to the flange 27. A distance D between the locking claw 58 and the flange 27 is less than the thickness T of the panel P. Accordingly, the front edge of the mount hole H pushes the locking claw 58 as the securing portions 30 engage the panel P during the mounting of the male housing 20 on the panel P. Thus, the locking piece 57 deforms resiliently and the locking claw 58 disengages from the locking portion 43, as shown in FIG. 29. Thus, the front edge He of the mount hole H is a disengaging means for disengaging the locking claw 58 from the locking portion 43, and hence the locked state of the detector 50 by the locking piece 57 is cancelled as the male housing 20 is mounted. The outer side surface of the locking portion 43 contacts the inner peripheral surface of the mount hole H as the locking surface engages the locking claw 58. Further, a disengagement-guiding surface 59 is formed on the rear surface of the locking claw 58 and slopes down and back. The inclined disengagement guiding surface 59 is pushed by the front edge He of the mount hole H, thereby guiding locking piece 57 through a smooth resilient deformation.

The thickness of the rear wall 35 is slightly larger than the thickness T of the panel P. Thus, a small engagement area of the locking portion 43 with the locking claw 58 remains when the male housing 20 is mounted on the panel P. However, this engagement area is such that the locking claw 58 easily can be disengaged from the locking portion 43 by a force operating the detector 50.

Figure 27:
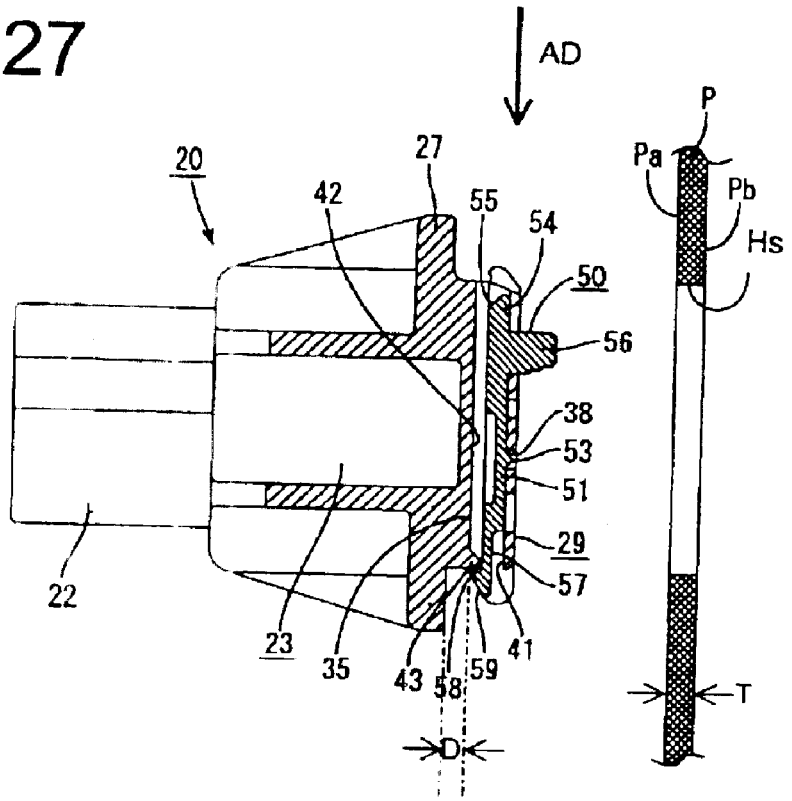
FIG. 27 is a section similar to FIG. 26, but showing the panel and the male housing having the detector mounted at a standby position.

The detector 50 is inserted in the accommodating direction AD into the detector-accommodating portion 29 of the male housing 20 and mounted at the standby position. The holding projection 53 engages the standby position holding hole 38 and the locking claw 58 of the locking piece 57 engages the outer side surface of the locking portion 43, as shown in FIG. 27. The locking surfaces of the locking claw 58 and the locking portion 43 are substantially normal to the moving or accommodating directions AD of the detector 50. Thus, the holding force is larger than the one given by the engagement of the holding projection 53 and the standby position holding hole 38. This prevents the detector 50 from inadvertently moving toward the detecting position before the male housing 20 is mounted on the panel P even if another part interferes with the detector 50.

The male housing 20 then is mounted in the mounting direction MD onto the panel P. An insufficient operation space might not be available at the rear side of the panel P of the door. However, the mounting operation may be performed by an operator at the front side of the panel P bringing his hand to the rear side of the panel P to grab the male housing 20 around the panel P. The male housing 20 is inclined so that the shorter sides extend obliquely up and back. The securing portions 30 then pass through the mount hole H and engage the front surface Pb of the panel P. In this process, the disengagement-guiding surface 59 of the locking piece 57 is pushed by the front edge He of the mount hole H. The locking piece 57 is guided by the inclination of the disengagement-guiding surface 59 and deforms to disengage the locking claw 58 from the locking portion 43. The locked state of the locking claw 58 is cancelled by the time the securing portions 30 engage the panel P. In this state, the detector 50 is held at the standby position only by the locking force given by the engagement of the holding projection 53 and the standby position holding hole 38.

Figure 28:
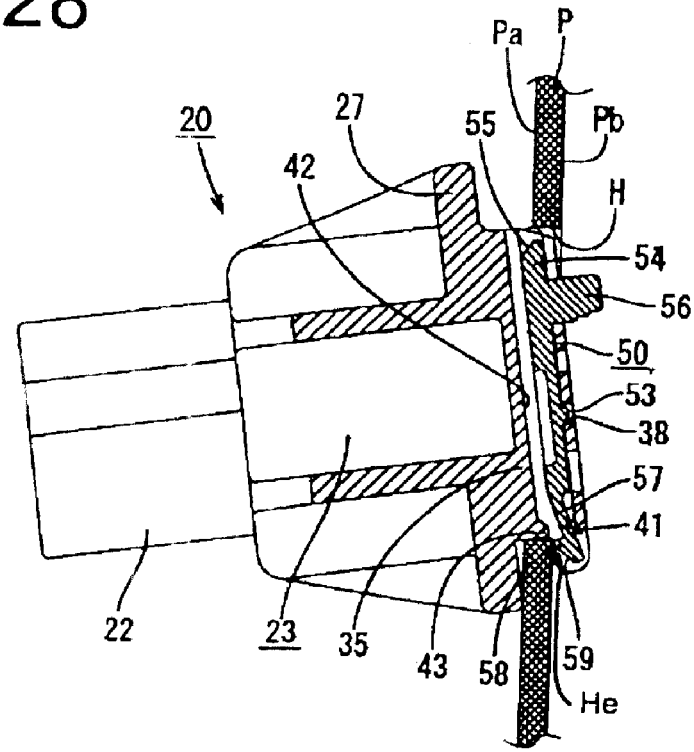
FIG. 28 is a section similar to FIG. 26, but showing the intermediate stage of mounting the male housing on the panel.

The male housing 20 then is rotated about the securing portions 30 into a vertical posture where the flange 27 is substantially parallel to the panel P. Thus, the slanted surfaces of the resilient locks 31 are pressed by the rear edge of the mount hole H and the resilient locks 31 are deformed resiliently and pushed through the mount hole H, as shown in FIG. 6. The detector 50 remains at the standby position during this process and passes through the mount hole H, as shown in FIG. 28. As the male housing 20 reaches its vertical posture, the entire front surface of the flange 27 substantially contacts the rear surface Pa of the panel P and the locks 31 are restored resiliently so that the locking claws 32 engage the front surface Pb of the panel P, as shown in FIG. 8. In this way, the male housing 20 is held properly mounted on the panel P while the panel P is held tightly between the flange 27 and the securing portions 30 and the locking claws 32 of the resilient locks 31.

Figure 30:
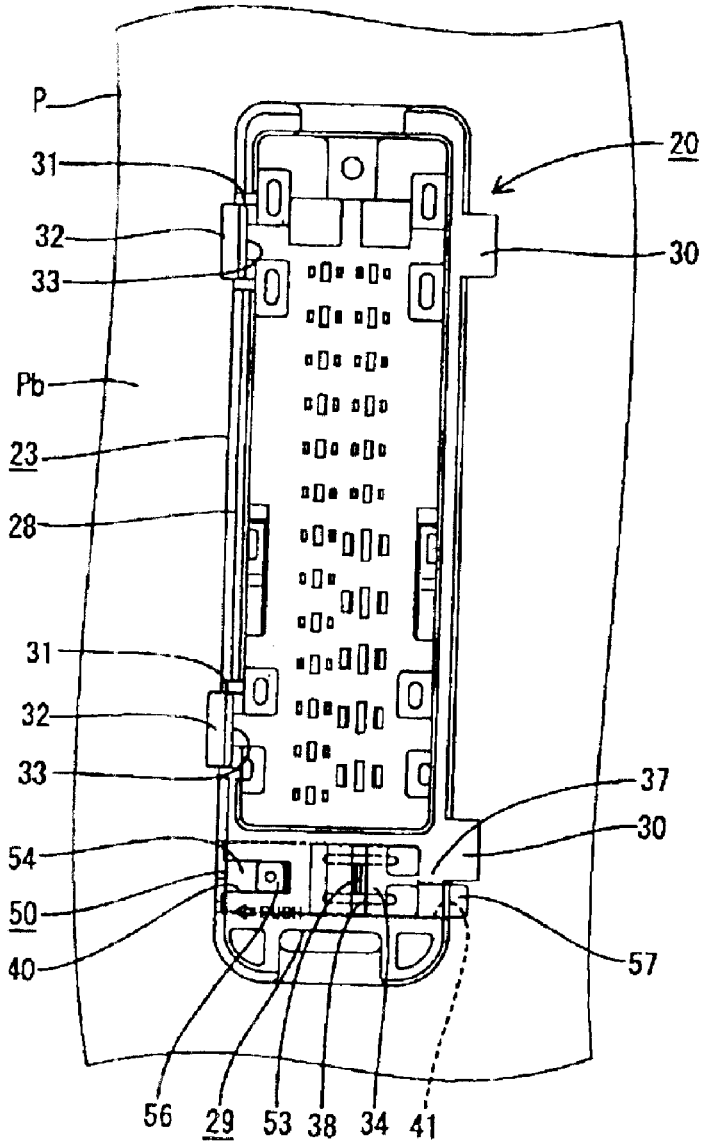
FIG. 30 is a front view showing the state where the male housing is properly mounted on the panel.
Figure 31:
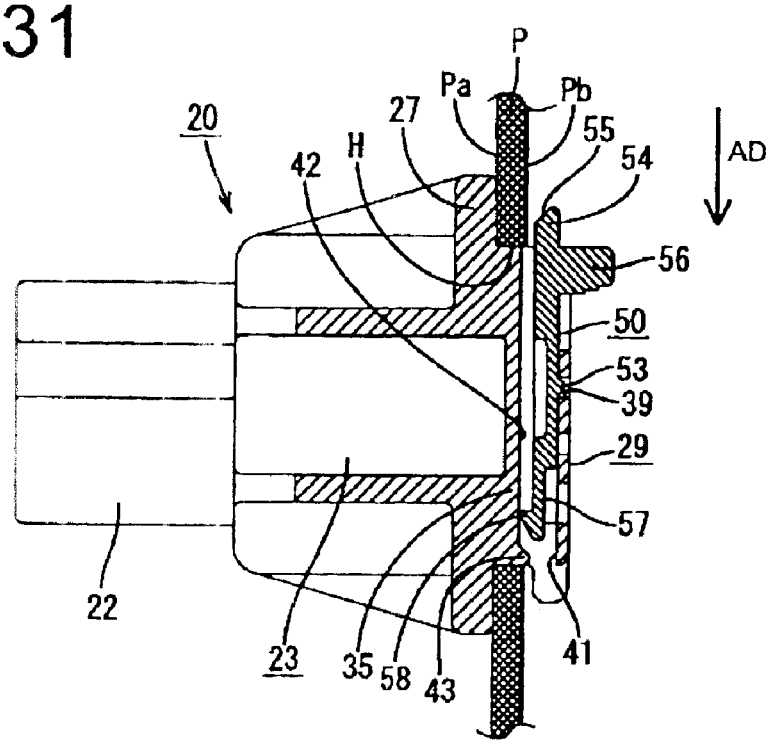
FIG. 31 is a section similar to FIG. 26, but showing a state reached by moving the detector to a detecting position.
Figure 32:
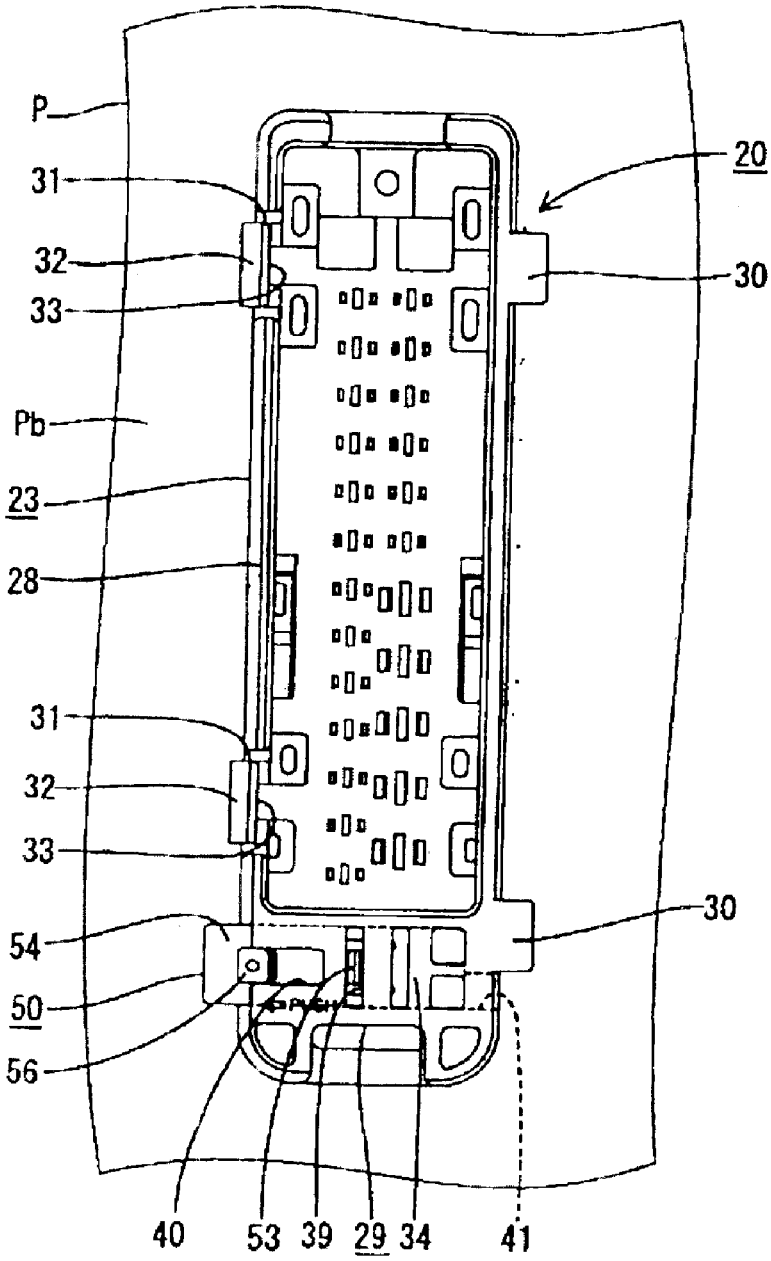
FIG. 32 is a front view showing the state reached by moving the detector to the detecting position.
Figure 33:
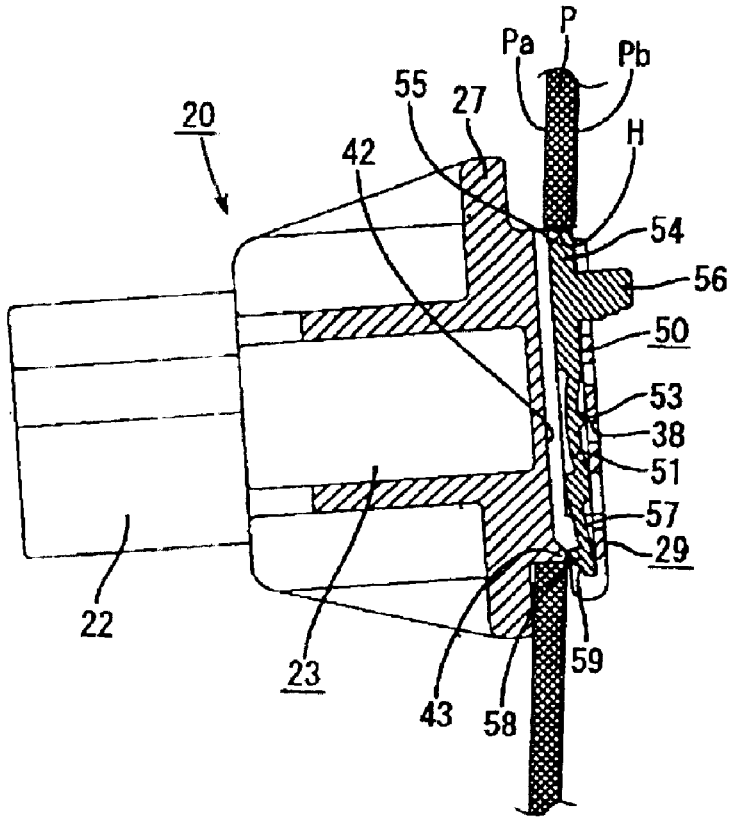
FIG. 33 is a section similar to FIG. 26, but showing a state where a detecting portion interferes with the inner peripheral surface of a mount hole.
Figure 34:
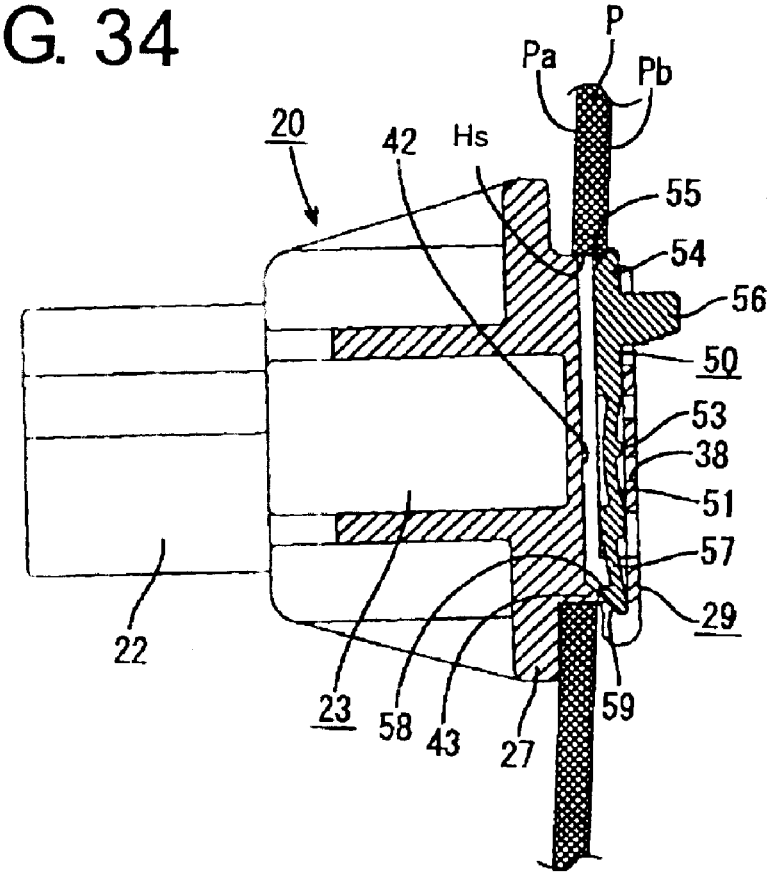
FIG. 34 is a section similar to FIG. 26, but showing a state where a guide surface is in contact with the front edge of the mount hole.

At this stage, the penetrating portion 28 and the detector-accommodating portion 29 are passed through the mount hole H. Additionally, the front surface of the rear wall 35 becomes substantially flush with the front surface Pb of the panel P and the detector 50 passes completely through the mount hole H to the front side of the panel P, as shown in FIGS. 29 and 30. The operable portion 56 then is pushed from the front side of the panel P to move the detector 50 to the detecting position. The detector 50 can be moved to the detecting position, as shown in FIGS. 31 and 32, because the detecting portion 54 does not interfere with the inner peripheral surface of the mount hole H. In this process, the locking claw 58 moves over the locking portion 43 and enters the entrance-permitting groove 42. The locking piece 57 then is restored resiliently in the detector-accommodating portion 29. The properly mounted state of the male housing 20 on the panel P can be confirmed by the movement of the detector 50 to the detecting position. At the detecting position, the detecting portion 54 engages the front surface Pb of the panel P at the side of the resilient locks 31. Thus, the detecting portion 54 is kept fixedly engaged with the panel P even if the resilient locks 31 are deformed inadvertently and disengaged from the panel P by the interference of another part. Accordingly, the detecting portion 54 and the securing portions 30 firmly hold the male housing 20 on the panel P.

Functions and effects of this embodiment are similar to the previous embodiment, so that reference is made thereto.

Figure 35:
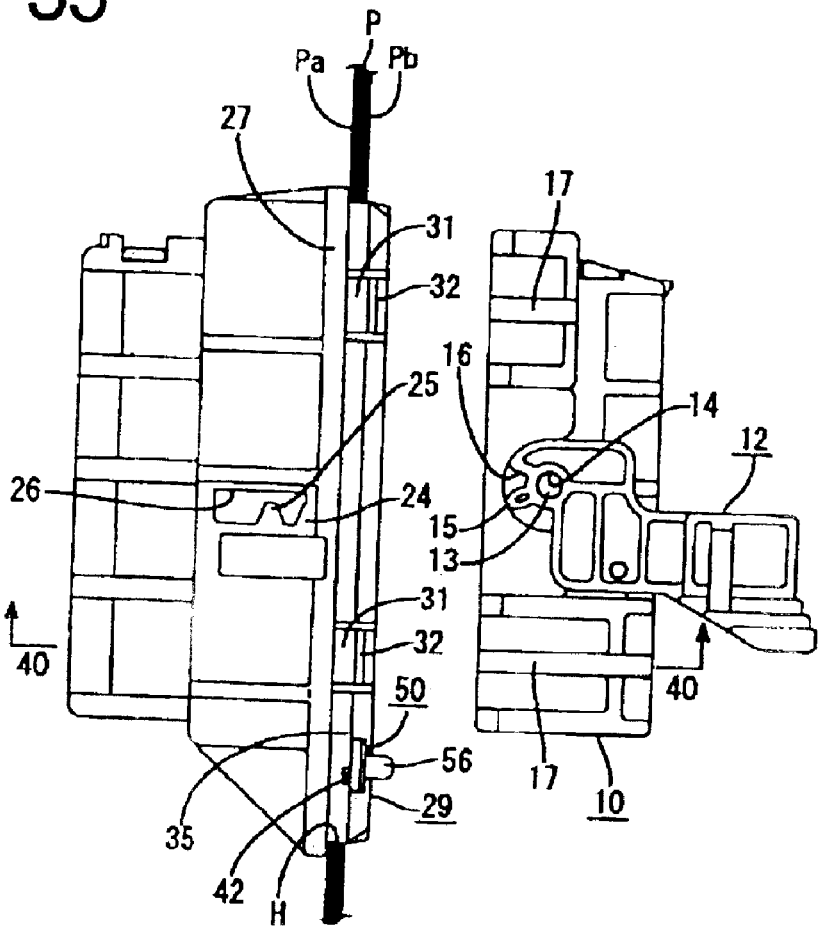
FIG. 35 is a side view showing the male housing mounted on the panel and the female housing having a lever mounted at an initial position.
Figure 36:
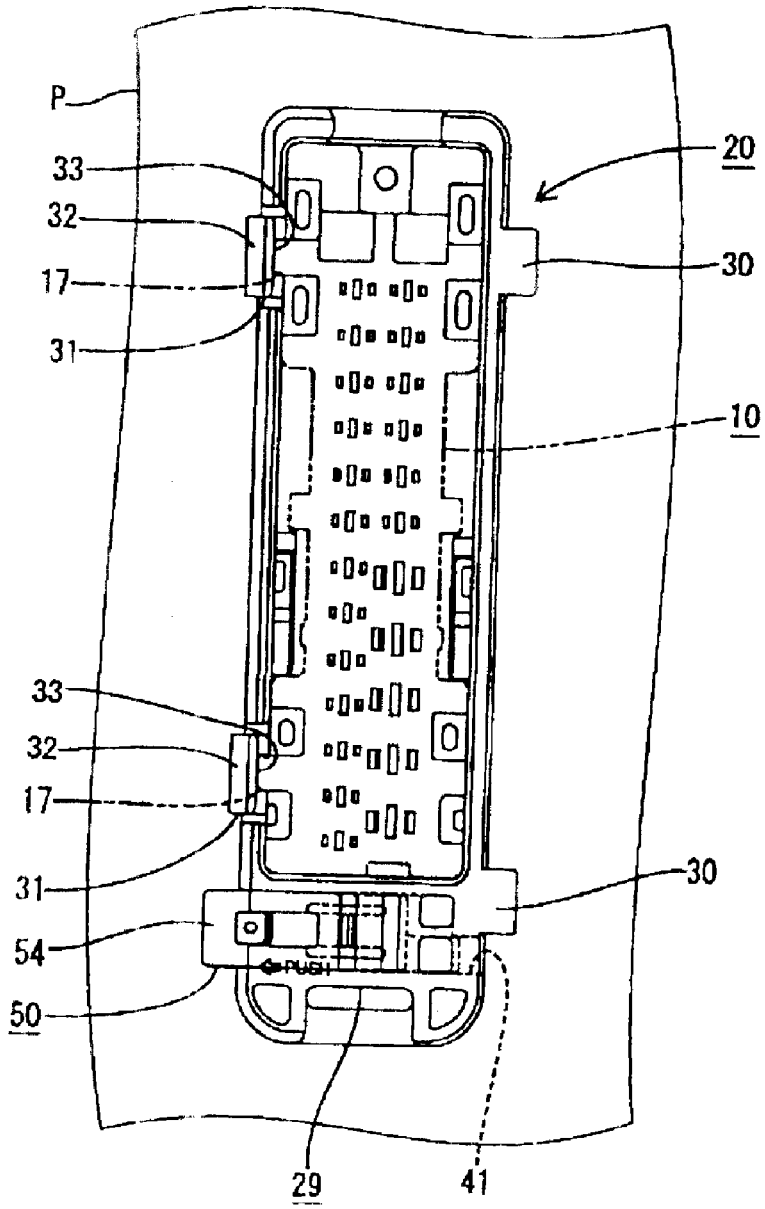
FIG. 36 is a front view showing a state where the female housing is connected with the male housing mounted on the panel.
Figure 37:
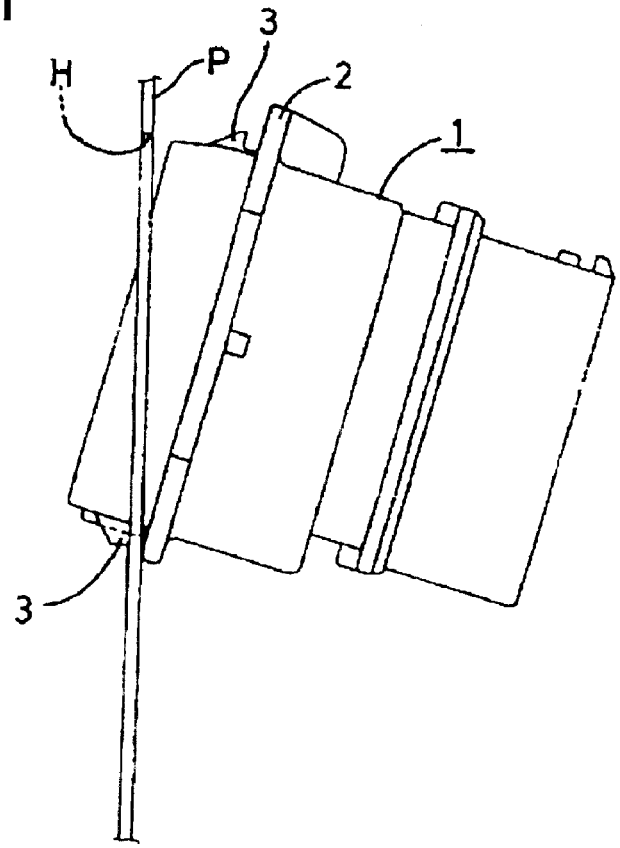
FIG. 37 PRIOR ART
FIG. 37 is a side view of a prior art connector.

Next, the female housing 10 is connected with the male housing 20 from the front side of the panel P, as shown in FIGS. 35 and 17, which is similar to the mounting method shown in the previous embodiment. The lever 12 then is rotated, as shown in FIG. 18, to properly connect the male and female housings 20, 10 as in the previously described embodiment.

According to this embodiment and similar to the previous embodiment, the mounted stated of the male housing 20 on the panel P can be detected based on whether the detector 50 can be moved to the detecting position. This can prevent the male housing 20 from being left partly mounted on the panel P. Further, the locking claw 58 of the locking piece 57 holds the detector 50 at the standby position in the male housing 10 and prevents the detector 50 from inadvertently moving toward the detecting position before the male housing 20 is mounted on the panel P. The detector 50 need not be returned to the standby position again after the male housing 20 is mounted on the panel P. Thus, operability is better.

The locking piece 57 is deformed by the front edge He of the mount hole H as the male housing 20 is mounted on the panel P. Thus, the locking claw 58 disengages from the locking portion 43, and the locked state of the detector 50 by the locking piece 57 is cancelled. Further, the mount hole H of the panel P is an existing structure. Therefore, the panel P need not have a special structure for disengaging the locking piece 57. Accordingly, the construction is simpler and production costs are lower. Furthermore, the disengagement guiding surface 59 smoothly deforms the locking piece 57, thereby improving operability.

An operator at the front side of the panel P may have to mount the male housing from the rear side of the panel P due to space limitations or other factors. The operable portion of the detector could be at the rear side of the panel in this situation, and could not be seen. Thus, the state of the operation would depend mostly on the feeling of the operator's fingertips. However, such a mounting operation can be performed efficiently with this embodiment because the operable portion 56 of the detector 50 is on the same side of the panel P as the operator.

The present invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The detector is movable along the shorter sides of the male housing in the illustrated embodiments. However, it may be movable along the longer sides of the male housing or obliquely according to the invention.

The detector is movable slightly from the standby position toward the detecting position before the detecting portion contacts the inner surface of the mount hole in the foregoing embodiments. However, the detecting portion may contact the inner surface of the mount hole without hardly moving the detector from the standby position by adjusting the length of the detecting portions or the like. Such an arrangement enables detection of the mounted state of the male housing based on whether the detector can be moved, thereby improving detection precision.

The inner peripheral surface of the mount hole is the preventing portion for the detector in the foregoing embodiment. However, the panel may have a preventing portion separate from the mount hole. In such a case, depending on the shape and the position of this preventing portion, the detector can be at the rear side of the panel without passing through the mount hole even after the male housing is mounted on the panel. In short, the detecting member need not necessarily be passed through the mount hole.

Although the operable portion of the detector projects to the front side of the panel in the foregoing embodiments, it may be at the rear side of the panel and operated at the rear side according to the present invention.

The detector is only at one end of the longer sides of the male housing in the foregoing embodiments. However, detectors may be at the opposite ends of the male housing if there is a sufficient space.

Grooves are formed at the inner sides of the resilient locks of the male housing and the deformation prevent portions project from the female housing in the foregoing embodiment. However, the resilient locks may not be formed with the grooves and the resilient deformation of the resilient locks may be prevented by the outer surface of the female housing.

Although the male housing is mounted on the panel in the foregoing embodiments, the present invention is similarly applicable to connectors in which female housings are mounted on panels.

The detector is assembled into the male housing and the edge of the mount hole of the panel serves as the preventing portion for interfering with the detecting portion of the detector in the foregoing embodiments. However, the detector may be assembled into the panel and the male housing may be provided with the preventing portion for interfering with the detector.

Although the mounted state of the male housing on the panel is mechanically detected by the detector in the foregoing embodiments, it may be detected optically by an optical sensor or the like or electrically detected.

In the foregoing embodiments, the lever was rotated to connect the male and female housings. However, connection of the housings may be assisted by another type of movable member (e.g. a substantially linearly movable member) with a cam means.

In the second embodiment, the locking piece is deformed and disengaged from the locking portion, taking advantage of the operation of mounting the male housing on the panel. However, this disengaging operation need not be linked with the mounting operation on the panel. The locking piece may not be deformed and disengaged from the lock until the detecting member is moved to the detecting position. Further, the disengaging means may be separate from the panel.

The locking piece of the detector may be engaged with the locking portion of the panel and the male housing may have a disengaging portion for disengaging the locking piece as the male housing is mounted on the panel.

What is claimed is:

1. A connector, comprising:

a housing mountable through a mount hole in a panel and comprising a holding means for holding the housing on the panel; and a detecting means for detecting whether the housing is mounted properly on the panel, the detecting means comprising a detector assembled to one of the housing and the panel for movement to a detecting position, the detecting means further comprising a preventing portion at the other of the housing and the panel for interfering with a detecting portion of the detector and hindering movement of the detector to the detecting position when the housing is mounted only partly on the panel, whereas the detecting portion does not interfere with the preventing portion and enables the detector to be moved to the detecting position when the housing is mounted properly on the panel.

2. The connector of claim 1, wherein the holding means is provided at the housing and comprises a contact for contacting a surface of the panel at the side where the housing is to be mounted, and a securing portion and a resilient lock for holding a surface of the panel opposite the contact.

3. The connector of claim 2, wherein the securing portion is first passed through the mount hole and engaged with the panel, and then the resilient lock can be deformed resiliently by an edge of the mount hole and passed through the mount hole for engagement with the panel.

4. The connector of claim 1, wherein the detecting portion has a guide surface for correcting posture of the housing to a substantially proper mounting posture by sliding contact with the preventing portion when the detector is moved to the detecting position before the housing is mounted properly.

5. The connector of claim 1, wherein:

the holding means is on the housing and comprises a contact for contacting a surface of the panel at the side where the housing is mounted, and a resilient lock which is deformed resiliently into a deformation space by an edge of the mount hole while the housing is being mounted and is restored resiliently to engage a surface of the panel at a side opposite from a side where the housing is mounted when the housing is mounted properly, thereby substantially tightly holding the panel between the resilient lock and the contact.

6. The connector of claim 1, further comprising a locking means for holding the detector at the standby position.

7. The connector of claim 6, wherein one of the housing and the panel comprises a disengaging means for canceling the locked state of the detector by the locking means as the housing is mounted on the panel.

8. The connector of claim 7, wherein the locking means is resiliently deformable and is provided on the detector, the locking means comprising a locking piece passed through the mount hole together with a securing portion of the housing, as the housing is mounted on the panel, and a locking portion on the housing, the locking portion being configured for holding the detector at the standby position by engaging the locking piece.

9. A connector, comprising:

a housing mountable through a mount hole in a panel and comprising a holding means for holding the housing on the panel; and a detecting means for detecting whether the housing is mounted properly on the panel, the detecting means comprising a detector assembled to one of the housing and the panel for movement to a detecting position, the detecting means further comprising a preventing portion at the other of the housing and the panel for interfering with a detecting portion of the detector and hindering movement of the detector to the detecting position while the housing is being mounted on the panel, whereas the detecting portion does not interfere with the preventing portion and enables the detector to be moved to the detecting position when the housing is mounted properly, wherein the detector is assembled to the housing and is movable along a direction intersecting a mounting direction of the housing to the panel, the detecting portion being passed through the mount hole as the housing is mounted properly on the panel, and the preventing portion being formed by an inner peripheral surface of the mount hole.

10. A connector, comprising:

a housing mountable through a mount hole in a panel and comprising a holding means for holding the housing on the panel; and a detecting means for detecting whether the housing is mounted properly on the panel, the detecting means comprising a detector assembled to one of the housing and the panel for movement to a detecting position, the detecting means further comprising a preventing portion at the other of the housing and the panel for interfering with a detecting portion of the detector and hindering movement of the detector to the detecting position while the housing is being mounted on the panel, whereas the detecting portion does not interfere with the preventing portion and enables the detector to be moved to the detecting position when the housing is mounted properly, wherein a detecting portion of the detecting means is engageable with a surface of the panel at a side opposite from a side where the housing is mounted when the detector reaches the detecting position.

11. A connector, comprising;

a housing mountable through a mount hole in a panel and comprising a holding means for holding the housing on the panel, wherein the holding means is provided at the housing and comprises a contact for contacting a surface of the panel at the side where the housing is to mounted, and a securing portion and a resilient lock for holding a surface of the panel opposite the contact; and a detecting means for detecting whether the housing is mounted properly on the panel, wherein the detector reaches the detecting position by being moved from a side of the housing having the securing portion to a side of the housing having the resilient lock and the detecting portion being engageable with the side of the panel engaged by to the resilient lock.

12. A connector, comprising:

a housing mountable through a mount hole in a panel and comprising a holding means for holding the housing on the panel; and a detecting means for detecting whether the housing is mounted properly on the panel, the detecting means comprising a detector assembled to one of the housing and the panel for movement to a detecting position, the detecting means further comprising a preventing portion at the other of the housing and the panel for interfering with a detecting portion of the detector and hindering movement of the detector to the detecting position while the housing is being mounted on the panel, whereas the detecting portion does not interfere with the preventing portion and enables the detector to be moved to the detecting position when the housing is mounted properly, wherein the housing is mountable from a rear side of the panel, and the detector has an operable portion enabling movement of the detector from the front side of the panel.

13. A connector, comprising;

a housing mountable through a mount hole in a panel and comprising a holding means for holding the housing on the panel, the holding means including a resilient lock which is deformed resiliently into a deformation space while the housing is being mounted and is restored resiliently to engage the panel when the housing is mounted properly; and a detecting means for detecting whether the housing is mounted properly on the panel, wherein the detecting means is on a mating housing connectable with the housing mounted on the panel and comprises a deformation preventing portion which enters the deformation space as the two housings are connected.

14. A connector comprising:

a housing mountable through a mount hole in a panel and comprising a holding means for holding the housing on the panel; and a detecting means for detecting whether the housing is mounted properly on the panel, the detecting means comprising a detector on one of the housing and the panel, the detector being movable from a standby position to a detecting position, resiliently deformable locking means formed on the detector for holding the detector releasably at the standby position, the locking means comprising a locking piece passed through the mount hole together with a securing portion of the housing as the housing is mounted on the panel, a locking portion on the housing configured for holding the detector at the standby position by engaging the locking piece and a disengaging means formed on one of the housing and the panel for canceling the lock state of the detector by the locking means as the housing is mounted on the panel, wherein the disengaging means is formed by the edge of the mount hole for resiliently deforming the locking piece, while disengaging it from the locking portion as the housing is mounted.

15. The connector of claim 14, wherein the locking piece is formed with a disengagement guiding surface for guiding the locking piece in its deforming direction by being pushed by the edge of the mount hole.

16. A method of mounting a housing of a connector on a panel, comprising the following steps:

providing a housing having a detector that is movable on the housing from a standby position to a detecting position;

releasably locking the detector at the standby position with a lock;

passing the housing through a mount hole formed in the panel and holding the housing mounted on the panel by a holding means, and moving the detector on the housing from the standby position to the detecting position for detecting whether the housing is mounted properly on the panel.

17. The method of claim 16, further comprising the step of canceling the locked state of the detector by the lock with a disengaging means on the panel, as the housing is mounted on the panel.

* * * * *